US008132907B2

(12) United States Patent
Kariya et al.

(10) Patent No.: US 8,132,907 B2
(45) **Date of Patent: *Mar. 13, 2012**

(54) IMAGE FORMING METHOD

(75) Inventors: Toshihiro Kariya, Kanagawa (JP); Hiroshi Yamamoto, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 556 days.

This patent is subject to a terminal disclaimer.

(21) Appl. No.: 12/272,875

(22) Filed: Nov. 18, 2008

(65) Prior Publication Data

US 2009/0128611 A1 May 21, 2009

(30) Foreign Application Priority Data

Nov. 19, 2007 (JP) ..... 2007-299772

(51) Int. Cl.
*B41J 2/01* (2006.01)

(52) U.S. Cl. ..... 347/105; 347/101

(58) Field of Classification Search ..... 347/100, 347/95, 96, 101, 105, 88, 99, 102; 106/31.6, 106/31.27; 523/160, 161; 428/195, 32.1
See application file for complete search history.

(56) References Cited

U.S. PATENT DOCUMENTS

2005/0012798 A1* 1/2005 Adachi et al. ..... 347/100
2006/0203056 A1* 9/2006 Furukawa et al. ..... 347/96

FOREIGN PATENT DOCUMENTS

JP 9-207424 A 8/1997
JP 2005-96285 A 4/2005
JP 2005-238829 A 9/2005
JP 2006-188045 A 7/2006
JP 2007136812 A * 6/2007

* cited by examiner

*Primary Examiner* — Manish S Shah
(74) *Attorney, Agent, or Firm* — Sughrue Mion, PLLC

(57) ABSTRACT

An image forming method including forming an image using a recording medium, an ink composition and a liquid composition, wherein the recording medium includes a base paper, a first layer containing a binder, and a second layer containing a white pigment, the first and second layers being laid in this order on the base paper, and wherein the base paper on which the first layer has been formed has a Cobb-water absorption degree of 5.0 g/m$^2$ or less as measured according to JIS P8140 with a contact time of 15 sec, the base paper on which the first and second layers have been formed has a water absorption amount of 2 mL/m$^2$ to 8 mL/m$^2$ as measured by the Bristow method with a contact time being 0.5 sec, the ink composition contains a pigment and water, and the liquid composition contains any one of polyvalent metal salt and cationic polymer.

11 Claims, 3 Drawing Sheets

IMAGE FORMING METHOD

BACKGROUND OF THE INVENTION

1. Field of the Invention

The present invention relates to an image forming method.

2. Description of the Related Art

Inkjet recording apparatuses, which have a simple configuration, can provide high-quality images through inkjet recording. In order to be desirably ejected from inkjet heads, inkjet inks are produced so as to have a viscosity of several mPa·s to about 30 mPa·s and a surface tension of about 20 mN/m to about 40 mN/m.

For producing an ink with a viscosity falling within the above range, the amount of an ink solvent is generally adjusted to 50% by mass to 90% by mass. Examples of the ink solvent used include water, organic solvents, oils and photopolymerizable monomers. Among them, water is often used from the viewpoint of giving less environmental load. Also, a high-boiling-point solvent (e.g., glycerin) is generally incorporated into the ink solvent so that the formed ink is prevented from drying to avoid clogging of ejection nozzles of the inkjet head.

When an ink containing a large amount of solvent is printed on a recording medium, the printed product involves image bleeding and color mixing. In view of this, recording media are provided with a solvent-absorbing layer (ink-receiving layer) having a thickness of about 20 μm to about 30 μm, and the obtained recording media are used as a paper sheet specialized for inkjet recording (FIG. 5) to prevent the occurrence of such unfavorable phenomena (i.e., image bleeding and color mixing).

In general, when an aqueous ink is used for inkjet recording, water serving as a solvent thereof infiltrates into base paper to cause deformation; e.g., curling and cockling. However, when a recording medium used have such a laminated structure that solvent-absorbing layers 22 are formed on base paper 21 (FIG. 5), the solvent-absorbing layers prevent water from infiltrating into the base paper, resulting in avoiding such deformation.

In addition, in forming graphical images with a high image density and a high image area ratio, a larger amount of ink is applied on per unit area of the recording medium and thus, the ink-absorbing layer cannot completely prevent infiltration of the ink solvent into the base paper. In this case, water-resistant paper (e.g., laminated paper) is used which has a water-resistant layer formed of polyolefin, etc. (see, for example, Japanese Patent Application Laid-Open (JP-A) Nos. 2005-238829 and 2005-96285).

Conventionally, inkjet recording techniques have been used in office printers and home printers. In recent years, they have also been being applied to the commercial printing field. This field requires not a printed product having a photo-like surface obtained by completely preventing infiltration of the ink solvent into the base paper, but a printed product having a texture like that obtained by printing generally used paper. Here, a recording medium having a solvent-absorbing layer with a thickness of 20 μm to 30 μm deteriorates the printed products in terms of, for example, surface glossiness, texture and stiffness. Thus, in the commercial printing field, the inkjet recording technique is merely applied, for example, to posters and ledger sheets in which degradation of the above properties is allowable. Also, use of a recording medium having a solvent-absorbing layer and/or a water-resistant layer leads to cost elevation, which is another cause of the above-described limited applications.

Some patent literatures disclose inkjet recording methods for forming high-quality images, where a separately provided liquid composition (reaction mixture) is applied onto a recording medium prior to jetting of inkjet ink (see, for example, JP-A Nos. 09-207424 and 2006-188045). In these methods, the liquid composition (treatment liquid) is applied onto the surface of recording media and then pigment ink is applied so that it is mixed with the treatment liquid in a liquid state. Such methods pose problems in that the fixing property of the formed images is degraded and the printed recording media involve deformation such as curling and cockling, which would not be observed in image formation using pigment ink alone.

BRIEF SUMMARY OF THE INVENTION

The present invention aims to solve the above-described problems pertinent in the art and to achieve the following objects. Specifically, an object of the present invention is to provide an image forming method which realizes highly reliable printing comparable to offset printing at high speed and low cost.

Means for solving the foregoing problems are as follows:

<1> An image forming method including:

forming an image using a recording medium, an ink composition and a liquid composition, wherein the recording medium includes a base paper, a first layer containing a binder, and a second layer containing a white pigment, the first layer and second layer being laid in this order on the base paper, and wherein the base paper on which the first layer has been formed has a Cobb-water absorption degree of 5.0 g/m$^2$ or less as measured according to the water absorption test stipulated in JIS P8140 with water being in contact with the first layer formed on the base paper for 15 sec, the base paper on which the first layer and the second layer have been formed has a water absorption amount of 2 mL/m$^2$ to 8 mL/m$^2$ as measured by the Bristow method with water being in contact with the second layer formed on the first layer and the base paper for 0.5 sec, the ink composition contains a pigment and water, and the liquid composition contains any one of a polyvalent metal salt and a cationic polymer.

According to the image forming method described in <1> above, the printed recording medium can be prevented from curling; the fixing property (abrasion resistance) of ink printed on recording media can be improved; and the aggregation rate of pigment particles contained in the ink composition can be increased to enhance printing speed (prevent image bleeding). Thus, the image forming method can perform highly reliable printing comparable to offset printing at high speed and low cost.

<2> The image forming method according to <1> above, wherein the polyvalent metal salt content of the liquid composition is 0.01% by mass to 10% by mass.

<3> The image forming method according to any one of <1> and <2> above, wherein the cationic polymer is selected from the group consisting of poly(vinylpyridine) salts, polyalkylaminoethyl acrylates, polyalkylaminoethyl methacrylates, poly(vinylimidazoles), polyethyleneimines, polybiguanides, polyguanides and combinations thereof.

<4> The image forming method according to <3> above, wherein the cationic polymer content of the liquid composition is 0.1% by mass to 15% by mass.

<5> The image forming method according to any one of <1> to <4> above, wherein the ink composition further contains at least one anionic polymer.

According to the image forming method described in <5> above, the aggregation rate of pigment particles contained in the ink composition can be further increased.

<6> The image forming method according to any one of <1> to <5> above, wherein the image forming method includes applying the liquid composition onto the recording medium and applying the ink composition onto the resultant recording medium.

<7> The image forming method according to any one of <1> to <6> above, wherein the ink composition is applied in a single-pass mode.

<8> The image forming method according to any one of <1> to <7> above, wherein the base paper on which the first layer has been formed has a Cobb-water absorption degree of 2.0 $g/m^2$ or less as measured according to the water absorption test stipulated in JIS P8140 with water being in contact with the first layer formed on the base paper for 2 min.

<9> The image forming method according to any one of <1> to <8> above, wherein the base paper on which the first layer has been formed has a Cobb value of 5.0 $g/m^2$ or less as measured using diethylene glycol in accordance with the procedure of the water absorption test stipulated in JIS P8140 with the diethylene glycol being in contact with the first layer formed on the base paper for 2 min, and wherein the base paper on which the first layer and the second layer have been formed has an absorption amount of 1 $mL/m^2$ to 6 $mL/m^2$ as measured by the Bristow method using a liquid containing 30% by mass diethylene glycol in pure water with the liquid being in contact with the second layer formed on the first layer and the base paper for 0.9 sec.

The present invention can provide an image forming method which realizes highly reliable printing comparable to offset printing at high speed and low cost. The image forming method can solve the existing problems and achieve the above objects.

DETAILED DESCRIPTION OF THE INVENTION

Figure 1:
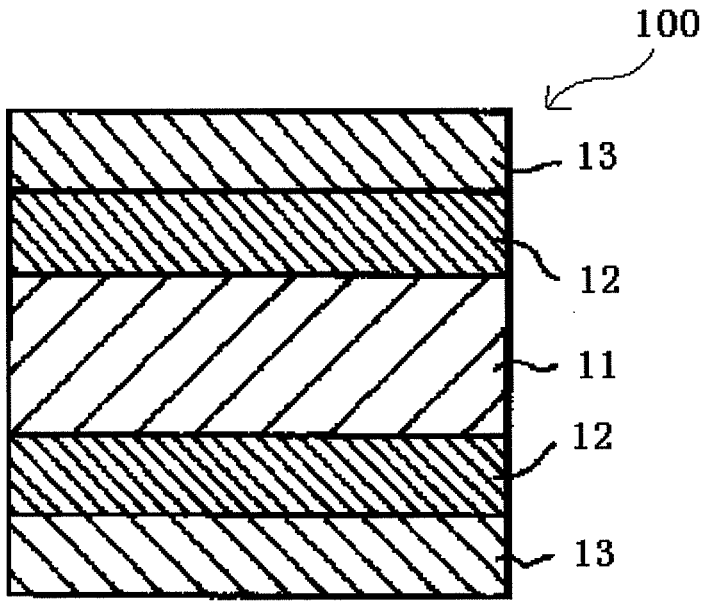
FIG. 1 is an explanatory view of a recording medium used in the present invention.

Referring now to the drawings, an image forming method of the present invention will be described.

(Image Forming Method)

The image forming method of the present invention uses a recording medium, an ink composition and a liquid composition.

Preferably, the image forming method includes a first application step where a liquid composition is applied onto a recording medium and a second application step where an ink composition is applied onto the resultant recording medium, and if necessary, further includes other steps appropriately selected depending on the purpose.

More preferably, printing is carried out in a single-pass mode.

<Recording Medium>

The recording medium includes a base paper, a first layer and a second layer, and if necessary, further includes other layers appropriately selected depending on the purpose.

As shown in FIG. 1, a recording medium 100, which is an exemplified recording medium used in the present invention, includes woodfree paper 11 serving as a base paper, solvent-blocking layers 12 serving as a first layer, and ink-absorbing layers 13 serving as a second layer, wherein the solvent-blocking layers 12 are formed on the woodfree paper 11 and the ink-absorbing layers 13 are formed on the solvent-blocking layers 12.

Also, the recording medium may be any of sheet paper and roll paper.

<<Base Paper>>

The base paper is not particularly limited and can be appropriately selected from those known in the art depending on the purpose.

The base paper is preferably formed of broad-leaf bleached kraft pulp (LBKP) from the viewpoint of simultaneously increasing the surface smoothness, rigidity and dimensional stability (resistance to curling) to satisfactory levels. In addition, needle-leaf bleached kraft pulp (NBKP), broad-leaf bleached sulfite pulp (LBSP), etc. may be used for forming the base paper.

The pulp may be beaten using a beater or refiner. If necessary, various additives are added to a pulp slurry formed after beating of the pulp (hereinafter the pulp slurry may be referred to as a "pulp paper material"). Examples of the additive include fillers, dry paper strengthening agents, sizing agents, wet paper strengthening agents, fixing agents, pH adjustors and other agents.

Examples of the filler include calcium carbonate, clay, kaolin, white clay, talc, titanium oxide, diatomaceous earth, barium sulfate, aluminum hydroxide and magnesium hydroxide. Examples of the dry paper strengthening agent include cationic starches, cationic polyacrylamides, anionic polyacrylamides, amphoteric polyacrylamides and carboxy-modified polyvinyl alcohols. Examples of the sizing agent include fatty acid salts, rosin, rosin derivatives (e.g., maleic rosin), paraffin waxes, alkyl ketene dimers, alkenyl succinic anhydrides (ASAs) and epoxidized fatty acid amides.

Examples of the wet paper strengthening agent include polyamine polyamide epichlorohydrin, melamine resins, urea resins and epoxidized polyamide resins. Examples of the fixing agent include polyvalent metal salts (e.g., aluminum sulfate and aluminum chloride) and cationic polymers (e.g., cationic starches).

Examples of the pH adjustor include caustic soda and sodium carbonate. Examples of the other agents include defoamers, dyes, slime control agents and fluorescent whitening agents. If necessary, a softening agent may be added to the pulp slurry. Examples of the softening agent include those described in, for example, *Shin-Kamikakobinran* "New edition-Paper and Paper Treatment Manual (published by Shiyaku Time Co., Ltd., 1980) (pp. 554 and 555)."

A treatment liquid used for the surface sizing treatment may contain a water-soluble polymer, a sizing agent, a water-resistant compound, a pigment, a pH adjustor, a dye, a fluorescent whitening agent, etc. Examples of the water-soluble polymer include cationic starches, polyvinyl alcohols, carboxy-modified polyvinyl alcohols, carboxymethyl cellulose, hydroxyethyl cellulose, cellulose sulfate, gelatin, casein, sodium polyacrylates, sodium salts of styrene-maleic anhydride copolymers and sodium polystyrene sulfonates.

Examples of the sizing agent include petroleum resin emulsions, ammonium salts of styrene-maleic anhydride copolymer alkyl esters, rosin, higher fatty acid salts, alkyl ketene dimers (AKDs) and epoxidized fatty acid amides.

Examples of the water-resistant compound include latexes/emulsions of styrene-butadiene copolymers, ethylene-vinyl acetate copolymers, polyethylenes, vinylidene chloride copolymers, etc.; and polyamide polyamine epichlorohydrin.

Examples of the pigment include calcium carbonate, clay, kaolin, talc, barium sulfate and titanium oxide. Examples of the pH adjustor include hydrochloric acid, caustic soda and sodium carbonate.

Examples of the base paper include natural pulp paper formed of the aforementioned pulp, synthetic pulp paper, mixed paper formed of natural pulp and synthetic pulp, and various combination paper. The base paper has a thickness of 30 μm to 500 μm, preferably 50 μm to 300 μm, more preferably 70 μm to 200 μm.

<<First Layer>>

The first layer is not particularly limited, so long as it contains a binder and the base paper on which it has been formed has a Cobb-water absorption degree of 5.0 g/m$^2$ or less as measured according to the water absorption test stipulated in JIS P8140 with water being in contact therewith for 15 sec, and can be appropriately selected from those known in the art depending on the purpose. Preferably, for example, the base paper on which the first layer has been formed has a Cobb-water absorption degree of 2.0 g/m$^2$ or less as measured according to the water absorption test stipulated in JIS P8140 with water being in contact with the first layer formed on the base paper for 2 min; the base paper on which the first layer has been formed has a Cobb value of 5.0 g/m$^2$ or less as measured using diethylene glycol in accordance with the procedure of the water absorption test stipulated in JIS P8140 with the diethylene glycol being in contact time with the first layer formed on the base paper for 2 min; the first layer contains, as the binder, at least one of a thermoplastic resin and a polyvinyl alcohol (in particular, an acetoacetyl-modified polyvinyl alcohol with a polymerization degree of 1,000 or more is preferred); the first layer further contains an inorganic layered compound; the ratio of the mass of polyvinyl alcohol (X) to the mass of water-swellable synthetic mica serving as the inorganic layered compound (Y): X/Y is 1 to 30; and the first layer further contains a hardener and/or a white pigment.

When the base paper on which a solvent-blocking layer (first layer) has been formed has a Cobb-water absorption degree of 5.0 g/m$^2$ or less as measured according to the water absorption test stipulated in JIS P8140 with water being in contact with the solvent-blocking layer formed on the base paper for 15 sec, reduction of paper strength and deformation due to swelling can be prevented in some degree. When it has a Cobb-water absorption degree of 2.0 g/m$^2$ or less as measured according to the water absorption test stipulated in JIS P8140 with water being in contact therewith for 2 min and has a Cobb value of 5.0 g/m$^2$ or less as measured using diethylene glycol in accordance with the procedure of JIS P8140 with the diethylene glycol being in contact therewith for 2 min, reduction of paper strength and deformation due to swelling can be almost completely prevented, which is preferred.

Specific means for imparting almost complete water-resistance to base paper is that a coating liquid mainly containing a water-dispersible latex, which has been prepared by dispersing a water-insoluble or poorly water-soluble hydrophobic polymer in an aqueous dispersion in the form of microparticles, is coated on base paper in a solid amount of 3 g/m$^2$ to 20 g/m$^2$ per one surface.

Also, in order for the resin surface to have hydrophilicity; i.e., not to repel water, a white pigment is incorporated into a coating liquid therefor in an amount of 5 parts by mass to 50 parts by mass per 100 parts by mass of the binder, and the resultant coating liquid is used for forming the solvent-blocking layer. The obtained base paper on which the first layer has been formed exhibits sufficient water resistance and allows easy coating of the second layer.

When the white pigment to be incorporated has an aspect ratio of 30 or more, the amount thereof can be increased to 200 parts by mass per 100 parts by mass of the binder. Moreover, use of such a white pigment allows not only easy coating of the second layer but also excellent handleabilities, among others, excellent cleaning performance.

<<Binder>>

The binder contained in the first layer is not particularly limited, so long as the layer contains at least one of a thermoplastic resin and a polyvinyl alcohol. Preferably, it contains a thermoplastic resin.

The thermoplastic resin is not particularly limited, and can be appropriately selected from known thermoplastic resins such as polyolefin resins (e.g., homopolymers of α-olefins such as polyethylene and polypropylene; and mixtures of the homopolymers) and latexes of the thermoplastic resins. Of these, preferred are thermoplastic resin latexes such as polyester urethane latexes, acrylic latexes, acrylic silicone latexes, acrylic epoxy latexes, acrylic styrene latexes, acrylic urethane latexes, styrene-butadiene latexes, acrylonitrile-butadiene latexes and vinyl acetate latexes, and at least one selected therefrom is preferably used. In particular, at least one of polyester urethane latexes and acrylic silicone latexes is preferably used.

Examples of the polyester urethane latexes include Hydran AP series and Hydran ECOS series (manufactured by Dainippon Ink and Chemicals, Inc.).

The aforementioned acrylic latexes may be commercially available products. Examples thereof include "Nipol Lx 811, 814, 821, 820 and 857" (manufactured by ZEON CORPORATION) and water-dispersible latexes of the acrylic resins "Cevian A4635, 46583 and 4601" (manufactured by DAICEL CHEMICAL INDUSTRIES, LTD.).

Particularly preferred are acrylic silicone latexes (acrylic emulsions) described in JP-A Nos. 10-264511, 2000-43409, 2000-343811 and 2002-120452 (specifically, for example, commercially available "Aquabrid series UM7760, UM7611, UM4901, MSi-045, ASi-753, ASi-903, ASi-89, ASi-91, ASi-86, 4635, MSi-04S, AU-124, AU-131, AEA-61, AEC-69 and AEC-162" (product name), manufactured by DAICEL CHEMICAL INDUSTRIES, LTD.).

The above thermoplastic resins may be used alone or in combination.

The thermoplastic resin preferably has a glass transition temperature (Tg) of 5° C. to 70° C., particularly preferably 15° C. to 50° C. The first layer-forming liquid (e.g., coating liquid) containing the thermoplastic resin whose Tg falls within the above range does not involve any difficulties (e.g., burr generation) during layer formation. In addition, differing from the case where the thermoplastic resin with too high Tg is used, through a calender treatment, high glossiness can be easily imparted to the formed first layer since considerably high temperature conditions are not required; and also, high smoothness can be easily imparted thereto since the surface conditions are not deteriorated due to undesired adhesion of the layer surface to the metal roller surface.

The thermoplastic resin preferably has a minimum film forming temperature of 20° C. to 60° C., more preferably 25° C. to 50° C. Advantageous effects given by adjusting the minimum required temperature for film formation to fall within the above range are as follows: the first layer-forming liquid (e.g., coating liquid) does not involve any difficulties (e.g., burr generation) during layer formation; during formation of the second layer, the surface conditions of the formed second layer are not deteriorated since the coating liquid therefor does not infiltrate into the first layer to a considerable extent; and a desired microporous first layer can be formed which allows the ink solvent to rapidly permeate. Before being subjected to further treatments, the layer obtained after coating of the liquid (e.g., coating liquid) does not exhibit excellent glossiness, but, through a calender treatment, a high-gloss, microporous layer can be obtained.

When the above composition is used to form the first layer, the thermoplastic resin content of the formed first layer is, on a solid basis, preferably 15% by mass to 95% by mass, more preferably 30% by mass to 90% by mass. When the content is adjusted to fall within the above range, the first layer exhibits such glossiness and smoothness as expected after calendering and exhibits sufficient ink-solvent permeability to effectively prevent ink bleeding occurring over time.

<<Acetoacetyl-Modified Polyvinyl Alcohol>>

Acetoacetyl-modified polyvinyl alcohol can be generally produced by reacting liquid or gaseous diketene with a solution (or dispersion) of polyvinyl alcohol resins or polyvinyl alcohol resin powder. The acetylation degree of the acetoacetyl-modified polyvinyl alcohol can be appropriately determined in consideration of the quality of the heat-sensitive recording material of interest. It is preferably 0.1 mol % to 20 mol %, with 0.5 mol % to 10 mol % being more preferred.

The polyvinyl alcohol resins encompass polyvinyl alcohols produced by saponifying a lower-alcohol solution of polyvinyl acetate; derivatives of the polyvinyl alcohols; and saponification products of copolymers formed between vinyl acetate and monomers copolymerizable therewith. Examples of the monomers copolymerizable with vinyl acetate include unsaturated carboxylic acids (e.g., maleic acid (anhydride), fumaric acid, crotonic acid, itaconic acid and (meth)acrylic acid) and esters thereof; α-olefins (e.g., ethylene and propylene); olefin sulfonic acids (e.g., (meth)allylsulfonic acid, ethylenesulfonic acid and sulfonic acid maleate); olefin sulfonic acid alkali salts (e.g., (meth)allylsulfonic acid soda, ethylenesulfonic acid soda, sulfonic acid soda (meth)acrylate, sulfonic acid soda (monoalkyl meleate) and disulfonic acid soda alkyl maleate); amide group-containing monomers (e.g., N-methylolacrylamide and acrylamide alkylsulfonic acid alkali salt); and N-vinylpyrrolidone derivatives.

In combination with the above-described acetoacetyl-modified polyvinyl alcohol, a compound dissolving in water of 25° C. in an amount of 5% by mass or more may be used as an additional binder in accordance with needs. Examples of such compounds (binders) include polyvinyl alcohols (including modified polyvinyl alcohols such as carboxy-modified polyvinyl alcohols, itaconic acid-modified polyvinyl alcohols, maleic acid-modified polyvinyl alcohols, silica-modified polyvinyl alcohols and amino group-modified polyvinyl alcohols), methyl cellulose, carboxymethyl cellulose, starch (including modified starch), gelatin, gum arabic, casein, styrene-maleic anhydride copolymer hydrolyzates, polyacrylamide and saponification products of vinyl acetate-polyacrylic acid copolymers. These additional binders are used not only for dispersing acetoacetyl-modified polyvinyl alcohol but also for increasing the strength of the formed film. In particular, in order to increase the film strength, binders such as latexes of synthetic polymers (e.g., styrene-butadiene copolymers, vinyl acetate copolymers, acrylonitrile-butadiene copolymers, methylacrylate-butadiene copolymers and polyvinylidnene chloride) may be used in combination with the acetoacetyl-modified polyvinyl alcohol. If necessary, appropriate crosslinking agents may be used depending on the type of the selected binder.

Also, the acetoacetyl-modified polyvinyl alcohol contained in the first layer has high oxygen-permeation-preventing performance and excellent S-S characteristics. Here, "S-S characteristics" refer to tensile energy absorption capacity (toughness) expressed by a stress-strain curve obtained until film breakage occurs. Thus, the first layer can freely stretch and shrink even during treatments with heating, involving no cracking and virtually no blister.

In the present invention, the acetoacetyl-modified polyvinyl alcohol preferably has a polymerization degree of 1,000 or more, more preferably 1,500 or more. Use of the acetoacetyl-modified polyvinyl alcohol with a polymerization degree of 1,000 or more can effectively prevent crack formation under low-humidity conditions (e.g., 20° C., 10%). Supposedly, the reason for this lies in that incorporation of the acetoacetyl-modified polyvinyl alcohol with such a relatively high polymerization degree (i.e., 1,000 or more) can remarkably increase breaking strength and break elongation of the first layer. Also, as the polymerization degree thereof is increased, so too does the viscosity of the formed coating liquid, resulting in deterioration of the conditions of the coated layer surface. Such deterioration, however, can be avoided by decreasing the concentration of the coating liquid and the content ratio of water-dispersible mica.

The modification rate of the acetoacetyl-modified polyvinyl alcohol is preferably 0.05 mol % to 20 mol %, more preferably 0.05 mol % to 15 mol %, from the viewpoints of providing the first layer with water resistance through reaction with the hardener and of being stably present in an aqueous solution.

The saponification degree of the acetoacetyl-modified polyvinyl alcohol is not particularly limited and is preferably 80% to 99.5%. The break elongation of the formed layer increases with decreasing of the saponification degree. Meanwhile, as the polymerization degree increases, so too does the saponification degree. When the acetoacetyl-modified polyvinyl alcohol has low polymerization degree, the saponification degree thereof is preferably decreased. Further, use of the acetoacetyl-modified polyvinyl alcohol with a decreased saponification degree is advantageous in that the viscosity of the formed coating liquid becomes low and the layer formed thereof is improved in surface leveling; i.e., in coated surface conditions.

<<Cobb-Water Absorption Degree>>

The Cobb-water absorption degree is measured by the water absorption test according to JIS P8140 (1998 ed.). In this test, one surface of paper is brought into contact with water in a predetermined time, and the amount of water absorbed by the paper is measured. Note that the contact time was set to 15 sec and 2 min.

<<Cobb Value>>

As used herein, the Cobb value is measured in accordance with the procedure of the water absorption test stipulated in JIS P8140 (1998 ed.). In this measurement, one surface of paper is brought into contact with diethylene glycol in a predetermined time, and the amount of diethylene glycol absorbed by the paper is measured. Note that the contact time was set to 2 min.

<<Inorganic Layered Compound>>

As mentioned above, preferably, the first layer further contains an inorganic layered compound. Preferred examples of the inorganic layered compound include swellable inorganic layered compounds such as swellable clay minerals (e.g., bentonite, hectorite, saponite, bidelite, nontronite, stivensite, beidellite and montmorillonite), swellable synthetic mica and swellable synthetic smectite. These swellable inorganic layered compounds have a laminated structure formed of unit crystal lattice layers with a thickness of 1 nm to 1.5 nm, and the degree of metal atom substitution in the lattice is markedly greater as compared with other clay minerals. As a result, a shortage of positive charges in the lattice layer arises and, in order to compensate for the shortage, $Na^+$, $Ca^{2+}$, $Mg^{2+}$ and other cations are adsorbed between the layers. These cations, called exchangeable cations, can be exchanged with various cations. In particular, when $Li^+$, $Na^+$ and other ions with a small ion radius exist between the laminated crystal lattice layers, the interlayer binding force is weak. Thus, the inorganic layered compounds having such crystal lattice layers are greatly swelled with water. In this state, cleavage easily occurs upon application of shearing force, forming a stable aqueous sol. Bentonite and swellable synthetic mica, among others, exhibit such behavior and are preferable to achieve the objects of the present invention. In particular, water swellable synthetic mica is preferable.

Examples of the water-swellable synthetic mica include Na-tetrasilicicmica ($NaMg_{2.5}(Si_4O_{10})F_2Na$), Li-taeniolite ($(NaLi)Mg_2(Si_4O_{10})F_2Na$) and Li-hectorite ($(NaLi)/3Mg_2/3Li_{1/3}(Si_4O_{10})F_2$).

The water swellable synthetic mica preferably used in the present invention has a thickness of 1 nm to 50 nm and a surface size of 1 μm to 20 μm. From the viewpoint of desirably controlling its diffusion, the thickness is preferably smaller to the greatest extent possible; and the surface size is preferably larger to the greatest extent possible, so long as it falls within such a range that the surface smoothness and transparency of the coated layer are not deteriorated. Thus, the aspect ratio of the water swellable synthetic mica is preferably 100 or more, more preferably 200 or more, particularly preferably 500 or more.

<<Mass Ratio>>

In the first layer, the ratio of the mass of the acetoacetyl-modified polyvinyl alcohol (X) to the mass of the water-swellable synthetic mica (Y): X/Y is preferably 1 to 30, more preferably 5 to 15. When the mass ratio falls within a range of 1 to 30, oxygen permeation and blister formation can be effectively prevented.

<<Hardener>>

The hardener contained in the first layer in the present invention is characterized by being at least one selected from aldehyde compounds; 2,3-dihydroxy-1,4-dioxane and derivatives thereof; and compounds having, in one molecule thereof, two or more vinyl groups neighboring substituents with a positive Hammett's substituent constant σp. Such a compound, which has been incorporated into the first layer, reacts with the acetoacetyl-modified polyvinyl alcohol, enhancing water resistance of the formed recording medium without thickening the first layer-coating liquid. As a result, there can be obtained recording media which have improved water resistance and in which the first layer-coating liquid is more stably coated.

Examples of the substituents with a positive Hammett's substituent constant σp include a $CF_3$ group (σp value: 0.54), CN group (σp value: 0.66), $COCH_3$ group (σp value: 0.50), COOH group (σp value: 0.45), COOR group (wherein R represents an alkyl group) (σp value: 0.45), $NO_2$ group (σp value: 0.78), $OCOCH_3$ group (σp value: 0.31), SH group (σp value: 0.15), $SOCH_3$ group (σp value: 0.49), $SO_2CH_3$ group (σp value: 0.72), $SO_2NH_2$ group (σp value: 0.57), $SCOCH_3$ group (σp value: 0.44), F group (σp value: 0.06), Cl group (σp value: 0.23), Br group (σp value: 0.23), I group (σp value: 0.18), $IO_2$ group (σp value: 0.76), $N^+(CH_3)_2$ group (σp value: 0.82) and $S^+(CH_3)_2$ group (σp value: 0.90).

Examples of the compounds having, in one molecule thereof, two or more vinyl groups neighboring substituents with a positive Hammett's substituent constant σp include 2-ethylenesulfonyl-N-[2-(2-ethylenesulfonyl-acetylamino)-ethyl]acetamide, bis-2-vinylsulfonyl ethyl ether, bisacryloylimide, N,N'-diacryloylurea, 1,1-bisvinylsulfone ethane, ethylene-bis-acrylamide, diacrylate compounds having the following structural formula, and dimethacrylate compounds having the following structural formula. Among them, 2-ethylenesulfonyl-N-[2-(2-ethylenesulfonyl-acetylamino)-ethyl]acetamide is particularly preferred.

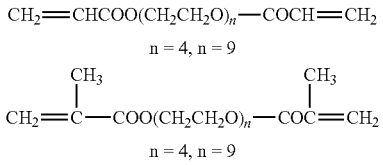

In the first layer, the amount of the compounds having, in one molecule thereof, two or more vinyl groups neighboring substituents with a positive Hammett's substituent constant σp is preferably 0.1% by mass to 30% by mass, more preferably 0.5% by mass to 10% by mass, with respect to that of the acetoacetyl-modified polyvinyl alcohol. When the amount is 0.5% by mass to 10% by mass, the water resistance of the formed recording medium can be effectively increased without thickening the first layer-coating liquid. This is the effect targeted by using the above compound in the present invention.

<<White Pigment>>

Examples of the white pigment include titanium oxide, barium sulfate, barium carbonate, calcium carbonate, lithopone, alumina white, zinc oxide, silica, antimony trioxide, titanium phosphate, aluminum hydroxide, kaolin, clay, talc, magnesium oxide and magnesium hydroxide. These may be used alone or in combination. In particular, kaolin is preferred.

<<<Kaolin>>>

Kaolin is preferably has an aspect ratio (diameter/thickness) of 30 or more. Examples of kaolin with an aspect ratio of 30 or more include engineered grade kaolin (e.g., Contour 1500 (aspect ratio: 59) and Astra-Plate (aspect ratio: 34)). When kaolin has high whiteness and a steep particle size distribution (uniform particle diameter), the coated paper is provided with excellent whiteness and printing suitability.

Preferably, 75% or more of the white pigment have a particle diameter of 2 μm or less and also, the average particle diameter is 0.1 μm to 0.5 μm. Use of such white pigment can effectively avoid decrease in whiteness and glossiness.

The titanium oxide may be of rutile or anatase type. Rutile-type titanium oxide and anatase-type titanium oxide may be used alone or in combination. Also, the titanium oxide may be produced through the sulfate process or the chloride process. It may be appropriately selected from those having undergone surface coating by use of an inorganic compound such as hydrous alumina, hydrous silicon dioxide or zinc oxide; those having undergone surface coating by use of an organic compound such as trimethylol methane, trimethylol ethane, trimethylol propane or 2,4-dihydroxy-2-methylpentane; and those treated with siloxane such as polydimethylsiloxane.

The white pigment preferably has a refractive index of 1.5 or higher. Such white pigment can contribute to formation of high-quality images.

Also, the white pigment preferably has a specific surface area less than 100 $m^2/g$ as measured by the BET method. Use of such white pigment can prevent infiltration of a second layer-coating liquid, resulting in enhancing ink-absorbability of the formed second layer.

Here, the BET method is a surface area measuring method for powder through the vapor-phase adsorption process. In this method, the overall surface area of a sample of 1 g (i.e., specific surface area) is determined from an adsorption isotherm curve thereof. Usually, nitrogen gas is used as an adsorption gas. The amount of gas adsorbed by the sample is generally measured based on a change in pressure or volume of the gas. The most famous equation representing an isotherm curve for multimolecular layer adsorption is the Brunauer-Emmett-Teller equation (i.e., BET equation). The adsorption amount is calculated from this equation, and the obtained value is multiplied by the area occupied with one adsorption molecule for determining the surface area.

The white pigment content of the first layer, which has been formed from the composition therefor, varies with, for example, the types of the white pigment and the thermoplastic resin, and the layer thickness. In general, it is preferably about 50 parts by mass to about 200 parts by mass per 100 parts by mass of the thermoplastic resin.

Note that the first layer may contain known additives such as an antioxidant.

The thickness of the first layer formed from the composition therefor is preferably 1 μm to 30 μm, more preferably 5 μm to 20 μm. When the layer thickness is adjusted to fall within the above range, the layer surface having undergone calendering exhibits high glossiness. In addition, the surface can be provided with whiteness by using even a small amount of the white pigment. Furthermore, the obtained recording media are comparable to coat paper or art paper in handleability such as a folding property. Another advantageous effect given by incorporating the white pigment into the composition is that the coated composition can be prevented from adhering to a calender during calendering.

<<Second Layer>>

The second layer is not particularly limited, so long as it contains a white pigment and the base paper on which the first layer and the second layer have been formed has a water absorption amount of 2 $mL/m^2$ to 8 $mL/m^2$ as measured by the Bristow method with water being in contact with the second layer formed on the first layer and the base paper for 0.5 sec, and can be selected from those known in the art depending on the purpose. Preferably, for example, the second layer has an absorption amount of 1 $mL/m^2$ to 6 $mL/m^2$ as measured by the Bristow method using a liquid containing 30% by mass diethylene glycol in pure water with the liquid being in contact therewith for 0.9 sec; it further contains a binder; it contains a white pigment in an amount of 10 parts by mass to 60 parts by mass per 100 parts by mass of a thermoplastic resin on a solid basis; and the film surface pH thereof is acidic.

When the base paper on which the first layer and the second layer have been formed has a water absorption amount more than 8 $mL/m^2$ as measured by the Bristow method with water being in contact with the second layer formed on the first layer and the base paper for 0.5 sec, the recording medium exhibits too high ink-solvent absorbing speed, causing poor aggregation in the vicinity of the surface. As a result, ink is transferred onto a fixing roller, causing smear on the printed products.

When the water absorption amount is less than 2 $mL/m^2$, ink components enclose their solvent during aggregation, causing problematic image deformation.

When the second layer has an absorption amount more than 6 $mL/m^2$ as measured by the Bristow method with a liquid containing 30% by mass diethylene glycol in pure water—almost equivalent to an actually used ink solvent—being in contact therewith for 0.9 sec, the same problem as described above arises; i.e., smear on the printed product is caused. When the water absorption amount is less than 1 $mL/m^2$, image deformation is undesirably caused.

Specific means for allowing the base paper on which the first layer and the 5 second layer have been formed to have a water absorption amount of 2 $mL/m^2$ to 8 $mL/m^2$ as measured by the Bristow method with water being in contact with the second layer formed on the first layer and the base paper for 0.5 sec, preferably, to have an absorption amount of 1 $mL/m^2$ to 6 $mL/m^2$ as measured by the Bristow method using a liquid containing 30% by mass diethylene glycol in pure water with the liquid being in contact with the second layer formed on the first layer and the base paper for 0.9 sec is that the binder content of the second layer is adjusted to 5 parts by mass to 15 parts by mass per 100 parts by mass of the white pigment.

<<White Pigment>>

The white pigment is not particularly limited and may be selected from those generally used in printing coat paper; e.g., calcium carbonate, kaolin, titanium dioxide, aluminum trihydroxide, zinc oxide, barium sulfate, satin white and talc. An advantageous effect given by incorporating the white pigment into the second layer is that pigment particles of ink can be retained in the layer.

<<Bristow Method>>

The Bristow method is the most popular method for measuring the absorption amount of liquid in short time, and is adopted by the Japan Technical Association of the Pulp and Paper Industry (J'TAPPI). It is described in detail in J'TAPPI No. 51 (2000 ed.) "*Kami, Itagamino Ekitai Kyushusei Shiken Houhou* (Test Method for Liquid Absorbability of Paper and Paper Board)." At the time of measurement of the liquid absorbability, the width of a head box slit in the Bristow method is adjusted depending on the surface tension of a test liquid. Note that points where the test liquid is leaked from the back surface of paper are not taken into account.

<<Binder>>

The binder is not particularly limited and may be, for example, those used in the first layer.

<<Film Surface pH>>

When the film surface pH of the second layer is adjusted acidic, ink components can be sufficiently aggregated and ink can be effectively fixed.

Examples of compounds used for making the film surface pH acidic in an embodiment of the present invention include phosphoric acid group-containing compounds, phosphonic acid group-containing compounds, phosphinic acid group-containing compounds, sulfuric acid group-containing compounds, sulfonic acid group-containing compounds, sulfinic acid, carboxylic acid and salts thereof, with phosphoric acid group-containing compounds and carboxylic acid being more preferred. Examples of the phosphoric acid group-containing compounds include phosphoric acid, polyphosphoric acid, derivatives of thereof and salts thereof. Examples of the carboxylic acid include compounds having a carboxyl group as a functional group and having a structure of furan, pyrrole, pyrroline, pyrrolidone, pyrone, thiophene, indole, pyridine or quinoline. Specific examples include pyrrolidonecarboxylic acid, pyronecarboxylic acid, pyrrolecarboxylic acid, furancarboxylic acid, pyridinecarboxylic acid, coumalic acid, thiophenecarboxylic acid, nicotinic acid, derivatives thereof and salts thereof. These compounds may be added to the second layer-coating liquid for adjusting the film surface pH acidic.

The film surface pH can be measured by Method A (coating method) stipulated in the Japan Technical Association of the Pulp and Paper Industry (J. TAPPI). Specifically, for example, it can be measured using a "pH Indicator Set for Surface of Paper (model MPC)" employing Method A (product of KYORITSU CHEMICAL-CHECK Lab., Corp.).

<Other Layers>

The other layers are not particularly limited and can be appropriately selected depending on the purpose.

<<Manufacturing Method for Recording Medium>>

A manufacturing method for the recording medium includes a first formation step and a second formation step, and if necessary, further includes appropriately selected other steps.

<<<First Formation Step>>>

The first formation step is not particularly limited, so long as the first layer-coating liquid is coated on the base paper and the thermoplastic resin microparticles contained therein are heated at a temperature of their minimum film forming temperature or higher, and can be appropriately selected depending on the purpose. Note that pressure may be applied to the thermoplastic resin microparticles together with heating.

The thermoplastic resin particles are not particularly limited and encompass all the conventionally known thermoplastic resin particles. Examples of such known thermoplastic resin include generally used thermoplastic polymers such as polyolefins (e.g., polyethylene, polypropylene and polyvinyl chloride), polyamides, polyimides and polyesters (e.g. polyethylene terephthalate); homopolymers made of α-methylene aliphatic monocarboxylates (e.g., methyl(meth)acrylate, ethyl(meth)acrylate, butyl(meth)acrylate, dodecyl(meth)acrylate, octyl(meth)acrylate and phenyl(meth)acrylate), styrenes (e.g., styrene, chlorostyrene and vinyl styrene), vinyl esters (e.g., vinyl acetate, vinyl propionate, vinyl benzoate and vinyl butylate), vinyl ethers (e.g., vinyl methyl ether, vinyl ethyl ether and vinyl butyl ether) and vinyl ketones (e.g., vinyl methyl ketone, vinyl hexyl ketone and vinyl isopropenyl ketone); and any copolymers having these monomers as a structural unit.

The above thermoplastic resins may be used alone or in combination.

The thermoplastic resin particles preferably have an average particle diameter of 10 nm to 200 nm. Herein, the average particle diameter of the resin particles refers to a value measured through dynamic light scattering with the "ELS-800" (product of OTSUKA ELECTRONICS CO., LTD.). The thermoplastic resin forming the resin particles preferably has a minimum film forming temperature (MFT) of 5° C. to 60° C.

The coating amount of the thermoplastic resin is preferably 1 $g/m^2$ to 30 $g/m^2$.

The thermoplastic resin particles preferably contain dispersed particles of water-dispersible latex from the viewpoints of, for example, improving production suitability and preventing cockling and ink-bleeding over time.

The water-dispersible latex is a dispersion in which a water-insoluble or poorly water-soluble hydrophobic polymer is dispersed in an aqueous dispersion medium in the form of microparticles. The hydrophobic polymer may be dispersed as emulsified products, emulsion-polymerized products or micelles. In addition, when it has a partial hydrophilic structure, the hydrophobic polymer may be dispersed by itself. These polymer latexes are described in detail, for example, in Taira Okuda and Hiroshi Inagaki, "*Gosei Jushi Emulsion* (Synthetic Resin Emulsion)" (published by Kobunshi Kankokai in 1978); Takaaki Sugimura, Yasuo Kataoka, Soichi Suzuki and Keiji Kasahara, "*Gosei Latex no Ouyo* (Application of Synthetic Latex)" (published by Kobunshi Kankokai in 1993); and Soichi Muroi, "*Gosei Latex no Kagaku* (Chemistry of Synthetic Latex)" (published by Kobunshi Kankokai in 1970).

Specific examples of the water-dispersible latex include acrylic latexes, acrylic silicone latexes, acrylic epoxy latexes, acrylic styrene latexes, acrylic urethane latexes, styrene-butadiene latexes, acrylonitrile-butadiene latexes and vinyl acetate latexes, and at least one selected therefrom is preferably used.

The water-dispersible latex preferably has a number average molecular weight of 3,000 to 1,000,000, more preferably about 5,000 to about 100,000. When the undercoat layer-coating liquid contains the water-dispersible latex having too low number average molecular weight, the formed undercoat layer may have an insufficient mechanical strength. Meanwhile, the water-dispersible latex having too high number average molecular weight may cause degraded production suitability; i.e., poor dispersion stability and/or high viscosity.

Among them, at least one of acrylic silicone latexes and acrylic styrene latexes is most preferably used for the first layer in the present invention, since they exhibit excellent ink-solvent permeability and effectively prevent cockling, which leads to be both economically advantageous and suitable for production.

<<<Second Formation Step>>>

The second formation step is not particularly limited, so long as a second layer is formed on the first layer, and can be appropriately selected depending on the purpose. Preferably, the coating liquid for forming the second layer is coated by blade coating and has a high-shear viscosity of 20 mPa·s to 150 mPa·s when the shear speed D ($=S/(t\times60\times10^{-6})$, wherein "S" denotes the coating speed (m/min) and "t" denotes the thickness of the coated layer (μm)), falls within a range of $10^3$ ($s^{-1}$) to $10^6$ ($s^{-1}$).

<<High-Shear Viscosity>>

The coating liquid for forming the second layer (overcoat layer) preferably has a high-shear viscosity of 30 mPa·s to 150 mPa·s, more preferably 40 mPa·s to 140 mPa·s.

When the overcoat layer-coating liquid has a high-shear viscosity less than 30 mPa·s, the coating amount thereof cannot be increased when blade coating is used. This is because the coating liquid does not infiltrate into the undercoat layer differing from the case where it is coated directly on the base paper. Whereas when the coating liquid has a high-shear viscosity more than 150 mPa·s, fluidity thereof becomes insufficient, causing difficulty in handling.

<<Blade Coating>>

The blade coating method is a coating method in which scraping of coating material applied on the paper substrate involves relatively high shear stress.

<<<Other Steps>>>

Examples of the other steps are not particularly limited and can be appropriately selected depending on the purpose.

<Ink Composition>

The ink composition contains a pigment and water, and if necessary, further contains a water-soluble solvent, an anionic polymer, latex particles and other additives, the additional components being appropriately selected depending on the purpose.

<<Pigment>>

The pigment is not particularly limited and can be appropriately selected depending on the purpose. Examples thereof include below-described organic pigments and carbon black. Preferably, the pigment is self-dispersible in water. The pigment that is self-dispersible in water refers to pigments that are stably dispersed in water with no use of a dispersant such as water-soluble polymeric compounds and that do not cause, in the dispersion, pigment aggregation leading to failure in normal ink-ejection.

—Organic Pigment—

Examples of organic pigments of orange and yellow include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, C.I. Pigment Yellow 128, C.I. Pigment Yellow 138, C.I. Pigment Yellow 151, C.I. Pigment Yellow 155, C.I. Pigment Yellow 180 and C.I. Pigment Yellow 185.

Examples of organic pigments of magenta and red include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222 and C.I. Pigment Violet 19.

Examples of organic pigments of green and cyan include C.I. Pigment Blue 15, C.I. Pigment Blue 15:2, C.I. Pigment Blue 15:3, C.I. Pigment Blue 15:4, C.I. Pigment Blue 16, C.I. Pigment Blue 60, C.I. Pigment Green 7 and siloxane-crosslinked aluminum phthalocyanines described in U.S. Pat. No. 4,311,775.

Examples of organic pigment of black include C.I. Pigment Black 1, C.I. Pigment Black 6 and C.I. Pigment Black 7.

The average particle diameter of the organic pigment is preferably smaller from the viewpoint of attaining desired transparency and color reproducibility; in contrast, it is preferably larger from the viewpoint of attaining desired light resistance. In order for the formed recording medium to simultaneously have transparency, color reproducibility and light resistance at desired levels, the average particle diameter is preferably 10 nm to 200 nm, more preferably 10 nm to 150 nm, still more preferably 10 nm to 100 nm. Meanwhile, the particle size distribution of the organic pigment is not particularly limited and may be broad or monodisperse. Also, two or more organic pigments each having a monodisperse particle size distribution may be used in combination.

The amount of the organic pigment used is preferably 1% by mass to 25% by mass, more preferably 2% by mass to 20% by mass, still more preferably 5% by mass to 20% by mass, particularly preferably 5% by mass to 15% by mass, with respect to the ink composition.

—Carbon Black—

The carbon black is not particularly limited and can be appropriately selected depending on the purpose. In particular, anionic self-dispersible carbon black is preferably used. Preferred examples thereof include those where at least one anionic group is bonded directly or via another atomic group to the surface of carbon black (pigment).

Examples of the anionic group bonded to the carbon black include —COOM, —$SO_3M$, —$PO_3HM$ and —$PO_3M_2$ (wherein M represents a hydrogen atom, alkali metal, ammonium or organic ammonium).

Examples of the alkali metal represented by "M" include lithium, sodium and potassium. Examples of the organic ammonium represented by "M" include mono-, di- and trimethyl ammonium; mono-, di- and triethyl ammonium; and mono-, di- and trimethanol ammonium.

Among the above anionic groups, —COOM and —$SO_3M$ are particularly preferred, since these groups contribute greatly to stabilization of a carbon black dispersion state.

In the anionic self-dispersible carbon black, the above anionic group is preferably bonded via another atomic group to the surface of carbon black. Examples of the atomic group include a linear or branched alkylene group having 1 to 12 carbon atoms, a substituted or non-substituted phenylene group and a substituted or non-substituted naphthylene group. Here, examples of substituents the phenylene and naphthylene groups may have include a linear or branched alkyl group having 1 to 6 carbon atoms.

Specific examples of the anionic group bonded to the atomic group, but not limited to, include —$C_2H_4COOM$, —$PhSO_3M$ and —PhCOOM (wherein Ph represents a phenyl group and M is the same as defined above).

The above-described carbon black, to which an anionic group is bonded directly or via another atomic group, is produced, for example, as follows.

Specifically, in one method for introducing a —COONa group to the surface of carbon black, commercially available carbon black is oxidized with sodium hypochlorite.

Also, in one method for bonding an —Ar—COONa group (wherein Ar represents an aryl group) to the surface of carbon black, an $NH_2$—Ar—COONa group is reacted with nitrous acid and then the formed diazonium salt is bonded to the carbon black surface. Needless to say, the bonding method is not limited thereto.

<<Water-Soluble Solvent>>

The water-soluble solvent is used, for example, for preventing drying of the ink composition and promoting wetting thereof. In addition, a dry inhibitor is preferably applied to inkjet ports of nozzles in inkjet-recording apparatuses for the purpose of preventing clogging due to drying of ink.

Preferably, the dry inhibitor is a water-soluble solvent having a vapor pressure less than that of water. Specific examples thereof include polyhydric alcohols (e.g., ethylene glycol, propylene glycol, diethylene glycol, polyethylene glycol, thiodiglycol, dithiodiglycol, 2-methyl-1,3-propanediol, 1,2,6-hexanetriol, acetylene glycol derivatives, glycerin and trimethylolpropane); lower alkyl ethers of polyhydric alcohols (e.g., ethylene glycol monomethyl (or ethyl) ether, diethylene glycol monomethyl (or ethyl) ether and triethylene glycol monoethyl (or butyl) ether); heterocyclic compounds (e.g., 2-pyrrolidone, N-methyl-2-pyrrolidone, 1,3-dimethyl-2-imidazolidinone and N-ethylmorpholine); sulfur-containing compounds (e.g., sulfolane, dimethylsulfoxide and 3-sulfolene); polyfunctional compounds (e.g., diacetone alcohol and diethanolamine); and urea derivatives. Among them, polyhydric alcohols such as glycerin and diethylene glycol are preferred. The above dry inhibitors may be used alone or in combination and are preferably incorporated into the ink composition in an amount of 10% by mass to 50% by mass.

In addition, a permeation promoter is preferably used for allowing ink to effectively permeate recording media (printing sheets). Preferred examples thereof include alcohols (e.g., ethanol, isopropanol, butanol, di(tri)ethylene glycol monobutyl ether and 1,2-hexanediol), sodium lauryl sulfate, sodium oleate and nonionic surfactants. The permeation promoter is incorporated into the ink composition in an amount of 5% by mass to 30% by mass for sufficiently exhibiting its effects. Also, it is preferably used in an amount not causing bleeding and print-through of the ink printed.

The water-soluble solvent is used also for adjusting the viscosity of the ink composition.

Specific examples of the water-soluble solvent which can be used for adjusting viscosity include alcohols (e.g., methanol, ethanol, propanol, isopropanol, butanol, isobutanol, sec-butanol, t-butanol, pentanol, hexanol, cyclohexanol and benzyl alcohol), polyhydric alcohols (e.g., ethylene glycol, diethylene glycol, triethylene glycol, polyethylene glycol, propylene glycol, dipropylene glycol, polypropylene glycol, butylene glycol, hexanediol, pentanediol, glycerin, hexanetriol and thiodiglycol), glycol derivatives (e.g., ethylene glycol monomethyl ether, ethylene glycol monoethyl ether, ethylene glycol monobutyl ether, diethylene glycol monomethyl ether, diethylene glycol monobutyl ether, propylene glycol monomethyl ether, propylene glycol monobutyl ether, dipropylene glycol monomethyl ether, triethylene glycol monomethyl ether, ethylene glycol diacetate, ethylene glycol monomethyl ether acetate, triethylene glycol monomethyl ether, triethylene glycol monoethyl ether and ethylene glycol monophenyl ether), amines (e.g., ethanolamine, diethanolamine, triethanolamine, N-methyldiethanolamine, N-ethyldiethanolamine, morpholine, N-ethylmorpholine, ethylenediamine, diethylenetriamine, triethylenetetramine, polyethyleneimine and tetramethylpropylenediamine) and other polar solvents (e.g., formamide, N,N-dimethylformamide, N,N-dimethylacetamide, dimethylsulfoxide, sulfolane, 2-pyrrolidone, N-methyl-2-pyrrolidone, N-vinyl-2-pyrrolidone, 2-oxazolidone, 1,3-dimethyl-2-imidazolidinone, acetonitrile and acetone). These water-soluble solvents may be used alone or in combination.

<<Anionic Polymer>>

When the above-described carbon black and organic pigments are used as a coloring material for forming ink, generally, a dispersant must be used in combination with the coloring material for dispersion. In order to achieve the effects of the present invention, the dispersant may be a compound which can stably disperse the coloring material and which has a functional group capable of causing crosslinking reaction when it is exposed to and mixed with the reaction mixture containing a polyvalent metal compound. More specifically, the dispersant is preferably an anionic compound which has an anionic group (e.g., a carboxyl group, a hydroxyl group and an amide group) and can stably disperse the coloring material by the action of the anionic group.

Examples of the dispersant which meets the above requirements and is preferably used in the ink composition include anionic polymers.

Specific examples thereof include styrene-acrylic copolymers, styrene-acrylic-alkyl acrylate copolymers, styrene-maleic copolymers, styrene-maleic-alkyl acrylate copolymers, styrene-methacrylic copolymers, styrene-methacrylic-alkyl acrylate copolymers, styrene-maleic half ester copolymers, vinylnaphthalene-acrylic copolymers, vinylnaphthalene-maleic copolymers, styrene-maleic anhydride-maleic half ester copolymers, and salts thereof.

The dispersant has a weight average molecular weight of 1,000 to 30,000, preferably 3,000 to 15,000. The dispersant content of the ink composition is preferably 5% by mass to 300% by mass with respect to the pigment content. When the dispersant content is less than 5% by mass, the dispersion stability may not be obtained and the film formed through reaction with a polyvalent metal compound contained in the reaction mixture may not have a sufficient strength. Whereas when the dispersion content is more than 300% by mass, the obtained ink composition has very high viscosity and degraded inkjet ability, which is not preferred.

<<Latex Particles>>

Examples of the latex particles include polymers formed of nonionic monomers, anionic monomers or cationic monomers.

The nonionic monomer refers to monomer compounds having no dissociative functional group. Broadly, the monomer compound refers to a compound that is polymerizable with itself or another compound. Preferred monomer compounds are those having an unsaturated double bond.

The anionic monomer refers to monomer compounds having an anionic group which can be negatively charged. The anionic group may be any groups. It is preferably a phosphoric acid group, phosphonic acid group, phosphinic acid group, sulfuric acid group, sulfonic acid group, sulfinic acid group and carboxylic acid group, with a phosphoric acid group and carboxylic acid group being more preferred, with a carboxylic acid group being still more preferred.

The cationic monomer refers to monomers having a cationic group which can be positively charged. The cationic group may be any groups. It is preferably organic cationic substituents, with nitrogen- or phosphorus-containing cationic groups being more preferred, with pyridinium cation and ammonium cation being still more preferred.

<<Other Additives>>

Examples of the other additives include known additives such as dry inhibitors (wetting agents), color-fading preventing agents, emulsion stabilizers, permeation promoters, UV ray absorbers, antiseptic agents, antifungal agents, pH adjustors, surface tension adjustors, defoamers, viscosity adjustors, dispersants, dispersion stabilizers, anticorrosion agents and chelating agents. In the preparation of an aqueous ink, these additives are added thereto at a final preparation step. In the preparation of a dispersion of oil-soluble dyes, these additives are generally added to the dispersion at a final preparation step, or these may be added in advance to the oil or aqueous phase during preparation.

The UV ray absorber is used for enhancing storage stability of the formed images. Examples thereof include benzotriazole compounds described in, for example, JP-A Nos. 58-185677, 61-190537, 02-782, 05-197075 and 09-34057; benzophenone compounds described in, for example, JP-A Nos. 46-2784 and 05-194483, and U.S. Pat. No. 3,214,463; cinnamic acid compounds described in, for example, Japanese Patent Application Publication Nos. 48-30492 and 56-21141, and JP-A No. 10-88106; triazine compounds described in, for example, JP-A Nos. 04-298503, 08-53427, 08-239368, 10-182621 and 08-501291; compounds described in Research Disclosure No. 24239; and compounds emitting fluorescent light upon absorbing UV rays (e.g., stilbene compounds and benzoxazole compounds)—so-called fluorescent brightening agents.

The color-fading preventing agent is used for enhancing storage stability of the formed images. Examples thereof include organic color-fading preventing agents (e.g., hydroquinones, alkoxyphenols, dialkoxyphenols, phenols, anilines, amines, indans, chromans, alkoxyanilines and heterocyclic compounds) and metal-complex color-fading preventing agents (e.g., nickel complexes and zinc complexes). Specific examples include compounds described in Research Disclosure Nos. 17643 (Items VII-I and J), 15162, 18716 (p. 650, left-hand column), 36544 (p. 527) and 307105 (p. 872); compounds in patent documents cited in Research Disclosure No. 15162; and compounds represented by the general formula described on pp. 127 to 137 of JP-A No. 62-215272 and exemplified compounds therein.

Examples of the antifungal agent include sodium dehydro acetate, sodium benzoate, sodium pyridinethion-1-oxide, ethyl p-hydroxybenzoate, 1,2-benzoisothiazolin-3-one and salts thereof. Preferably, these are used in ink in an amount of 0.02% by mass to 1.00% by mass.

The pH adjustor used may be neutralizing agents such as organic basic compounds and inorganic alkaline compounds. It is preferably added to inkjet ink so that the pH is adjusted to 6 to 10, more preferably 7 to 10, for the purpose of enhancing storage stability thereof.

Examples of the surface tension adjustor include nonionic surfactants, cationic surfactants, anionic surfactants and betaine surfactants.

The surface tension adjustor is preferably added to ink in such an amount that the surface tension is adjusted to 20 mN/m to 60 mN/m, more preferably 20 mN/m to 45 mN/m, still more preferably 25 mN/m to 40 mN/m, for the purpose of attaining excellent inkjet performance.

Preferred examples of the surfactant include hydrocarbon anionic surfactants such as fatty acid salts, alkyl sulfuric acid ester salts, alkylbenzene sulfonic acid salts, alkylnaphthalene sulfonic acid salts, dialkylsulfosuccinic acid salts, alkyl phosphoric acid ester salts, naphthalene sulfonic acid formalin condensates and polyoxyethylenealkyl sulfuric acid ester salts; hydrocarbon nonionic surfactants such as polyoxyethylene alkyl ethers, polyoxyethylene alkylallyl ethers, polyoxyethylene fatty acid esters, sorbitan fatty acid esters, polyoxyethylene sorbitan fatty acid esters, polyoxyethylene alkylamines, glycerin fatty acid esters and oxyethylene-oxypropylene block copolymers; acetylene polyoxyethylene oxide surfactants such as SURFYNOLS (AirProducts&ChemicaLs Inc.); and amineoxide type amphoteric surfactants such as N,N-dimethyl-N-alkylamine oxide.

Further examples include those described on pp. 37 and 38 of JP-A No. 59-157636 and Research Disclosure No. 308119 (1989 ed.).

In addition, there can be used fluorine (alkyl fluoride) surfactants, and silicone surfactants, etc. described in JP-A Nos. 2003-322926, 2004-325707 and 2004-309806, and these can improve abrasion resistance of ink printed.

The above-listed surface tension adjustors can be used also as a defoamer. Furthermore, fluorine compounds, silicone compounds, chelating agents (e.g., EDTA), etc. can be used.

<Liquid Composition>

The liquid composition contains at least one of a polyvalent metal salt and a cationic polymer, and if necessary, further contains appropriately selected other additives.

<<Polyvalent Metal Salt>>

Preferred examples of polyvalent metal cations which form the polyvalent metal salt include $Zn^{2+}$, $Mg^{2+}$, $Ca^{2+}$, $Cu^{2+}$, $Co^{2+}$, $Ni^{2+}$, $Fe^{2+}$, $La^{2+}$, $Nd^{3+}$, $Y^{3+}$ and $Al^{3+}$. Typical examples of anions which can serve as a counter ion thereof include, but not limited to, $NO_3^-$, $F^-$, $Cl^-$, $Br^-$, $I^-$, $CH_3COO^-$ and $SO_4^-$. The polyvalent metal salt contained in the liquid composition can increase the aggregation rate of pigment particles contained in the ink composition. The polyvalent metal salt content of the liquid composition is preferably 0.01% by mass to 10% by mass, more preferably 2% by mass to 5% by mass. When the content is less than 0.01% by mass, the aggregation rate of pigment particles cannot be increased; whereas when the content is more than 10% by mass, uniformity in solid image areas and color development are adversely affected.

<<Cationic Polymer>>

Examples of the cationic polymer include poly(vinylpyridine) salts, polyalkylaminoethyl acrylates, polyalkylaminoethyl methacrylates, poly(vinylimidazoles), polyethyleneimines, polybiguanides, polyguanides and combinations thereof. The cationic polymer contained in the liquid composition can increase the aggregation rate of pigment particles contained in the ink composition. The cationic polymer content of the liquid composition is preferably 0.1% by mass to 15% by mass, more preferably 0.5% by mass to 6% by mass.

<<Other Additives>>

Examples of acidic compounds used for making the liquid composition acidic, include phosphoric acid group-containing compounds, phosphonic acid group-containing compounds, phosphinic acid group-containing compounds, sulfuric acid group-containing compounds, sulfonic acid group-containing compounds, sulfinic acid, carboxylic acid and salts thereof. In particular, phosphoric acid group-containing compounds and carboxylic acid are preferred, with carboxylic acid being more preferred. Examples of the carboxylic acid include compounds having a carboxyl group as a functional group and having a structure of furan, pyrrole, pyrroline, pyrrolidone, pyrone, thiophene, indole, pyridine or quinoline. Specific examples include pyrrolidonecarboxylic acid, pyronecarboxylic acid, pyrrolecarboxylic acid, furancarboxylic acid, pyridinecarboxylic acid, coumalic acid, thiophenecarboxylic acid and nicotinic acid. These compounds, derivatives thereof, or salts thereof are added to the liquid composition.

Among the above acidic compounds, preferred are pyrrolidonecarboxylic acid, pyronecarboxylic acid, furancarboxylic acid, coumalic acid, derivatives thereof, and salts thereof. These compounds may be used alone or in combination.

The liquid composition may contain other additives, so long as the effects of the present invention are not impeded. Examples thereof include known additives such as dry inhibitors (wetting agents), color-fading preventing agents, emulsion stabilizers, permeation promoters, UV ray absorbers, antiseptic agents, antifungal agents, pH adjustors, surface tension adjustors, defoamers, viscosity adjustors, dispersants, dispersion stabilizers, anticorrosion agents and chelating agents.

<First Application Step>

The first application step is not particularly limited, so long as the liquid composition is applied onto a recording medium, and can be appropriately selected depending on the purpose.

<Second Application Step>

The second application step is not particularly limited, so long as the ink composition is applied onto the recording medium obtained after application of the liquid composition, and can be appropriately selected depending on the purpose. Preferably, the applied liquid composition onto which the ink composition is to be applied is in a wet state.

<Other Steps>

The other steps are not particularly limited and can be appropriately selected depending on the purpose. Examples thereof include a drying step and a heat-fixing step.

—Drying Step—

The drying step is not particularly limited, so long as the solvent of the ink composition that has been applied onto the recording medium is removed by drying, and can be appropriately selected depending on the purpose. The recording medium has, as the second layer, a slow-permeable ink-absorbing layer and thus, the drying step is carried out in a state where the ink solvent (water) is present in the vicinity of the recording medium surface.

—Heat-Fixing Step—

The heat-fixing step is not particularly limited, so long as latex particles of ink used in the inkjet-recording method are fused and fixed, and can be appropriately selected depending on the purpose.

Figure 2:
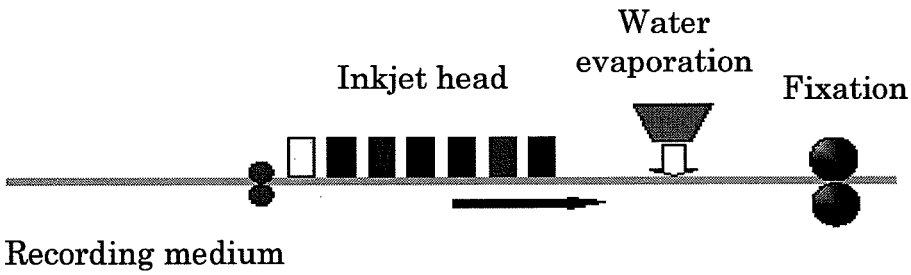
FIG. 2 is an explanatory view of a first embodiment of the inkjet recording method of the present invention.
Figure 3:
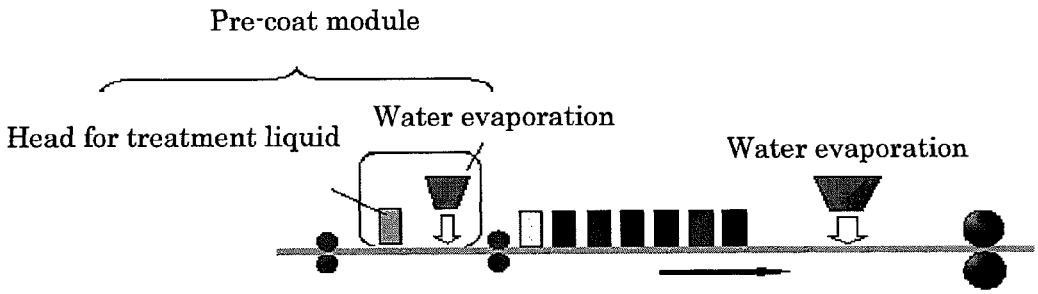
FIG. 3 is an explanatory view of a second embodiment of the inkjet recording method of the present invention.

Examples of the image forming method include image forming methods 1 (FIG. 2) and 2 (FIG. 3). In the image forming method 1, application of the ink composition and other treatments are carried out on a recording medium whose second layer (ink-absorbing layer) has previously impregnated with the liquid composition. Meanwhile, in the image forming method 2, the liquid composition is applied (pre-coated) onto a recording medium and then application of the ink composition and other treatments are carried out.

—Image Forming Method 1—

In the image forming method 1, for example, application of the ink composition (ink-printing), drying (water evaporation, air dry) and fixing are carried out under the following conditions.

—Application of Ink Composition (Ink-Printing)—

Head: full-line head (1,200 dpi/20 inch width)

Amount of droplet ejected: 0 pL, 2.0 pL, 3.5 pL and 4.0 pL used for recording

Drive frequency: 30 kHz (conveyance speed of recording medium: 635 mm/sec)

—Drying (Water Evaporation, Air Dry)—

Air-blasting speed: 8 m/s to 15 m/s

Temperature: 40° C. to 80° C.

Air-blasted region: 640 mm (drying time: 1 sec)

—Fixation—

Silicone rubber rollers (hardness: 50°, nip width: 5 mm)

Roller temperature: 70° C. to 90° C.

Pressure: 0.5 MPa to 2.0 MPa

—Image Forming Method 2—

In the image forming method 2, for example, pre-coating, application of the ink composition (ink-printing), drying (water evaporation, air dry) and fixing are carried out under the following conditions.

—Head for Treatment Liquid in Pre-Coat Module—

Head: full-line head (600 dpi/20 inch width)

Amount of droplet ejected: 0 pL and 4.0 pL used for recording

Drive frequency: 15 kHz (conveyance speed of recording medium: 635 mm/sec)

Printed pattern: liquid composition is previously applied onto a portion where printing is to be carried out with at least one color ink in the ink composition application step —Water Evaporation (Air Dry) for Pre-Coat Module—

Air-blasting speed: 8 m/s to 15 m/s

Temperature: 40° C. to 80° C.

Air-blasted region: 450 mm (drying time: 0.7 sec)

—Application of Ink Composition (Ink-Printing)—

Head: full-line head (1,200 dpi/20 inch width)

Amount of droplet ejected: 0 pL, 2.0 pL, 3.5 pL and 4.0 pL used for recording

Drive frequency: 30 kHz (conveyance speed of recording medium: 635 mm/sec)

—Drying (Water Evaporation, Air Dry)—

Air-blasting speed: 8 m/s to 15 m/s

Temperature: 40° C. to 80° C.

Air-blasted region: 640 mm (drying time: 1 sec)

—Fixation—

Silicone rubber rollers (hardness: 50°, nip width: 5 mm)

Roller temperature: 70° C. to 90° C.

Pressure: 0.5 MPa to 2.0 MPa

EXAMPLES

The present invention will next be described in detail by way of examples, which should not be construed as limiting the present invention thereto.

In the Examples, unless otherwise specified, the units "parts" and "%" are on a mass basis and the "polymerization degree" refers to the "average polymerization degree."

Example 1

<Preparation of Coating Liquid for Forming First Layer (Undercoat Layer)>

(1) Preparation of acetoacetyl-modified polyvinyl alcohol

Water (88 parts) was added to acetoacetyl-modified polyvinyl alcohol (saponification degree: 95% to 97%; polymerization degree: 1,000; product name: Gosefimer Z-210 (product of Nippon Synthetic Chemical Industry Co., Ltd.)) (12 parts), and the resultant mixture was stirred at 90° C. or higher for dissolution.

(2) Water-swellable mica dispersion (aspect ratio: 1,000; product name: Somasif MEB-3 (8% solution) (product of CO-OP Chemical Co., Ltd.); average particle diameter of mica: 2.0 μm)

(3) Ethylene oxide surfactant (product name: Emulex 710 (product of Nihon-Emulsion Co., Ltd.) (1.66% by mass solution in methanol))

Water (58 parts) was added to the above-prepared (1) 12% by mass solution of acetoacetyl-modified polyvinyl alcohol (100 parts), followed by sufficiently stirring/mixing. Subsequently, the above (2) 8% by mass water-swellable mica dispersion (18 parts) was added to the resultant mixture, followed by sufficiently stirring/mixing. Thereafter, the above (3) 1.66% by mass ethylene oxide surfactant solution (3 parts) was added thereto. The thus-obtained liquid mixture was maintained at 30° C. to 35° C. to prepare an undercoat layer-coating liquid.

<Preparation of Coating Liquid for Forming Second Layer (Overcoat Layer)>

Heavy calcium carbonate (product name: Escaron #2000, product of SANKYO SEIFUN) (60 parts), kaolin (product name: Milagros, product of Engelhard (U.S.)) (20 parts), titanium oxide (Typaque R-780, product of ISHIHARA SANGYO KAISHA, LTD.) (20 parts) and 43% poly sodium acrylate (product name: ARON T-50, product of TOAGOSEI, CO., LTD.) (0.5 parts) were mixed with one another. The resultant mixture was dispersed in water with the kneader NBK-2 (product of NISSEI Corporation). Subsequently, styrene-butadiene copolymer latex (average particle diameter: 95 nm, product name: Smartex PA2323, product of NIPPON A&L) (11 parts), oxidized starch (product name: ACE B, product of Oji Cornstarch Co., Ltd.) (3 parts) and a lubricant (product name: SN coat 231SP, product of SAN NOPCO LIMITED) (1 part) were added to the dispersion, to thereby prepare an overcoat layer-coating liquid with a final solid content of 65%.

<Formation of First Layer (Undercoat Layer)>

The above-prepared undercoat layer-coating liquid was applied on each of both surfaces of woodfree paper having a basis weight of 81.4 g/m$^2$ (product name: Shiraoi, product of Nippon Paper Co.) with a bar coater to a coating amount of 8.0 g/m$^2$, followed by drying at 50° C. for 3 min, to thereby form an undercoat layer. The thus-formed undercoat layer was found to have a thickness of 8.1 μm.

<Formation of Second Layer (Overcoat Layer)>

The above-prepared overcoat layer-coating liquid was applied on each of the undercoat layers formed on the woodfree paper using a high-speed sheet-fed blade coater (PM-9040M, product of SMT Co., Ltd.), followed by drying at 150° C. for 3 sec (air-blasting speed: 20 m/sec), to thereby form an overcoat layer. Note that the coating was performed so that the coating amount by mass was adjusted to 10 g/m$^2$ in a dried state. The thus-formed overcoat layer was found to have a thickness of 11.2 μm.

<Application of Liquid Composition>

Liquid composition A containing the following components was coated on the above-obtained recording medium with a bar coater.

—Liquid Composition A—

Glycerin: 7 parts

Diethylene glycol: 5 parts

Olfine E1010 (product of Nissin Chemical Industry Co., Ltd.): 2 parts

Magnesium nitrate: 3 parts

Ion-exchange water: 83 parts

<Application of Ink Composition>

Ink composition A prepared as described below was coated on the above-obtained recording medium, on which liquid composition A had been coated, by the method shown in FIG. 2 under the following conditions.

—Ink Composition A—

The dispersion CAB-O-JETTM_200 (carbon black) (product of CABOT Co.) (10 g), a low-molecular-weight dispersant 2-1 (10.0 g), glycerin (4.0 g) and ion-exchange water (26 g) were stirred/mixed to prepare a dispersion. Subsequently, using an ultrasonic wave irradiation apparatus (Vibra-cell VC-750, tapered microtip: 5 mm in diameter, Amplitude: 30%, product of SONICS Co.), the thus-prepared dispersion was intermittently irradiated with ultrasonic waves (irradiation: 0.5 sec, intermittence: 1.0 sec) for 2 hours for further dispersing pigment, to thereby prepare a 20% by mass pigment dispersion. Note that the low-molecular-weight dispersant 2-1 has the following chemical structure:

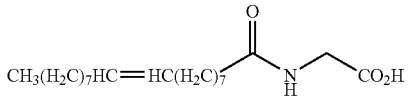

Separately, the following compounds were weighed and stirred/mixed to prepare Mixture I.

Glycerin: 5.0 g

Diethylene glycol: 10.0 g

Olfine E1010 (manufactured by Nissin Chemical Industry Co., Ltd.): 1.0 g

Ion-exchange water: 11.0 g

Mixture I was gradually added dropwise to a 44% SBR dispersion (polymer microparticles: acrylic acid (3% by mass); glass transition temperature (Tg): 30° C.) (23.0 g) under stirring to prepare Mixture II.

Mixture II was gradually added dropwise to the above-prepared 20% by mass pigment dispersion under stirring to prepare 100 g of pigment ink K. The thus-prepared pigment ink K was measured for its pH value with the pH meter WM-50EG (product of DKK TOA CORPORATION), and was found to have a pH of 8.5.

—Application of Ink Composition (Ink-Printing)—

Head: full-line head (1,200 dpi/20 inch width)

Amount of droplet ejected: 0 pL, 2.0 pL, 3.5 pL and 4.0 pL used for recording

Drive frequency: 30 kHz (conveyance speed of recording medium: 635 mm/sec)

—Drying (Water Evaporation, Air Dry)—

Air-blasting speed: 15 m/s

Temperature: 55° C. measured on the surface of recording medium

Air-blasted region: 640 mm (drying time: 1 sec)

—Fixation—

Silicone rubber rollers (hardness: 500, nip width: 5 mm)

Roller temperature: 85° C.

Pressure: 1.0 MPa

<Evaluation>

Before application of the liquid composition, the recording medium was subjected to "test for Cobb-water absorption degree of woodfree paper with undercoat layer being formed thereon" and "water absorption test for woodfree paper with undercoat layer and overcoat layer being formed thereon." The recording medium on which the ink composition had been applied was subjected to "test for bleeding of ink printed," "curling test" and "test for abrasion resistance." The results are shown in Table 1.

—Test for Cobb-Water Absorption Degree of Woodfree Paper with Undercoat Layer Being Formed Thereon—

(1) According to the water absorption test stipulated in JIS P8140, the surface of the undercoat layer on the woodfree paper was measured for its Cobb-water absorption degree (the amount of water absorbed when the surface was in contact with water of 20° C. for 15 sec (g/m$^2$)).

(2) According to the water absorption test stipulated in JIS P8140, the surface of the undercoat layer on the woodfree paper was measured for its Cobb-water absorption degree (the amount of water absorbed when the surface was in contact with water of 20° C. for 2 min (g/m$^2$)).

(3) According to the water absorption test stipulated in JIS P8140, the surface of the undercoat layer on the woodfree paper was measured for its Cobb value (the amount of diethylene glycol absorbed when the surface was in contact with diethylene glycol of 20° C. for 2 min (g/m$^2$)).

—Water Absorption Test for Woodfree Paper with Undercoat Layer and Overcoat Layer Being Formed Thereon—

The water absorption amount was measured according to the Bristow method as follows.

Figure 4:
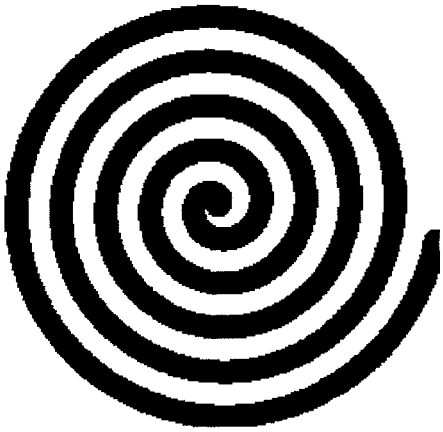
FIG. 4 illustrates a scanning line of a head filled with a test liquid used in the Bristow method.
Figure 5:
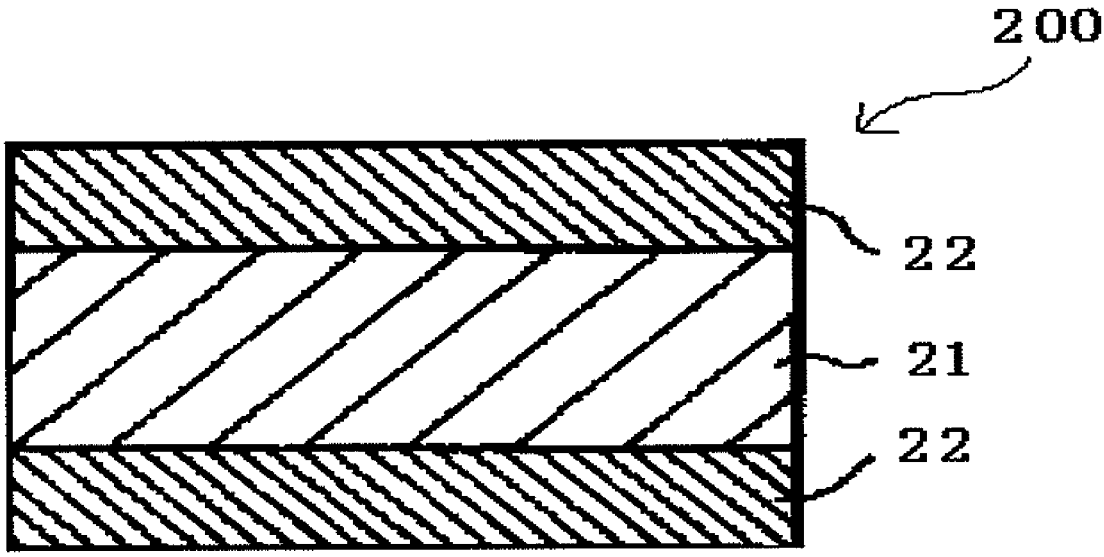
FIG. 5 is an explanatory view of a conventional recording medium.

(1) The woodfree paper with the undercoat layer and the overcoat layer being formed thereon was cut into an A6 size sheet, and the cut sheet was placed on a measuring plate. A head filled with a test liquid was brought into contact with the sheet (the overcoat layer formed on the undercoat layer and the woodfree paper), and then was automatically moved to scan thereon along the scanning line shown in FIG. 4 (from within outward) to give liquid absorption characteristics thereof. Specifically, in this test, the measuring plate is rotated while changing the rotating speed in a stepwise manner (i.e., while changing the contact time between paper and test liquid), to thereby give a relationship between the contact time and the liquid absorption amount (water absorption amount). Table 1 shows water absorption amounts determined at a contact time of 0.5 sec.

(2) The procedure performed in (1) was repeated, except that water was changed to a liquid containing 30% by mass diethylene glycol in pure water. Table 1 shows liquid absorption amounts determined at a contact time of 0.9 sec.

—Test for Bleeding of Ink Printed—

Printing of a 4 pt outline character was carried out, and the character of the printed product was magnified with a microscope to evaluate its sharpness and resolution according to the following criteria.

A: Sharp character edge observed, and good resolution

B: Character edge somewhat bled, but practically non-problematic

C: Character legible but bled, and practically problematic

D: Poor character resolution and bleeding observed, and practically problematic

—Curling Test—

The obtained recording medium was cut into a test piece of 50 mm (in a MD)×5 mm (in a CD) and the thus-cut test piece was coated with water at 10 g/m$^2$. According to the curl (curvature) measuring method stipulated in JAPAN TAPPI Paper and Pulp Test Method No. 15-2:2000, the obtained test piece was left to stand at 23° C. and 50% RH for 8 hours and then was evaluated for its curling degree according to the following criteria.

A: Curling degree<10

B: 10≦curling degree≦20

C: 20≦curling degree<30

D: 30≦curling degree

—Test for Abrasion Resistance—

Immediately after application of the ink composition, a 2 cm×2 cm solid portion of the recording medium was abraded by finger pressure. Subsequently, the ink attached on the finger was transferred to a blank portion of the recording medium. The degree of the amount of the ink transferred to the blank portion (ink-transfer degree (abrasion resistance)) was visually observed and evaluated according to the following evaluation criteria. The results are shown in Table 1.

<Evaluation Criteria for Abrasion Resistance>

A: No ink-transfer observed

B: Ink-transfer almost unnoticeable

C: Ink-transfer somewhat observed

D: Ink-transfer considerably observed

Example 2

The procedure of Example 1 was repeated, except that an undercoat layer-coating liquid was prepared as described below, that the amount of the undercoat layer-coating liquid coated on one surface of woodfree paper was changed from 8.0 g/m$^2$ to 10.0 g/m$^2$, and that a soft calender treatment was carried out, to thereby perform an image forming method. The formed undercoat layer was found to have a thickness of 9.0 μm, and the formed overcoat layer 9.6 μm. Similar to Example 1, "test for Cobb-water absorption degree of woodfree paper with undercoat layer being formed thereon," "water absorption test for woodfree paper with undercoat layer and overcoat layer being formed thereon," "test for bleeding of ink printed," "curling test" and "test for abrasion resistance" were performed. The results are shown in Table 1.

<Preparation of Undercoat Layer-Coating Liquid>

Titanium dioxide (product name: Taque R-780, product of ISHIHARA SANGYO KAISHA, LTD.) (100 parts), 25% special polycarboxylic acid polymer Na salt (product name: DEMOL EP, product of Kao Corp.) (1.2 parts), and water (121.7 parts) were mixed with one another, and the resultant mixture was dispersed with a non-bubbling kneader (product name: NBK-2, product of NISSEI Corporation) to prepare a 45% titanium dioxide dispersion. Subsequently, the thus-prepared 45% titanium dioxide dispersion (8.6 parts) and water (100 parts) were added to a 35% aqueous acrylic latex dispersion (glass transition temperature: 60° C., minimum film forming temperature: 50° C., product name: Aquabrid 4635, manufactured by DAICEL CHEMICAL INDUSTRIES, LTD.) (100 parts), followed by sufficiently stirring/mixing. The thus-obtained liquid mixture was maintained at 15° C. to 25° C. to prepare an 18.0% undercoat layer-coating liquid.

<Formation of Undercoat Layer>

The above-prepared undercoat layer-coating liquid was coated on each of both surfaces of woodfree paper having a basis weight of 81.4 g/m$^2$ (product name: Shiraoi, product of Nippon Paper Co.) with a bar coater to a coating amount of 10.0 g/m$^2$, followed by drying at 50° C. for 3 min, to thereby form an undercoat layer. The thus-formed undercoat layer was subjected to a soft calender treatment as described below.

—Soft Calender Treatment—

The soft calender treatment was carried out with respect to the undercoat layer formed on the woodfree paper with a soft calender having a pair of metal and resin rollers under the following conditions: surface temperature of the metal roller: 80° C., nip pressure: 100 kg/cm and speed: 100 m/min.

Example 3

The procedure of Example 1 was repeated, except that an undercoat layer-coating liquid was prepared as described below, that an undercoat layer is formed as described below, that an overcoat layer-coating liquid was prepared as described below, that an overcoat layer was formed as described below, and that a soft calender treatment was carried out, to thereby perform an image forming method.

<Preparation of First Layer (Undercoat Layer)-Coating Liquid>

Kaolin (product name: Kaobrite 90, product of SHIRAISHI CALCIUM KAISHA, LTD.) (100 parts), 0.1N sodium hydroxide (product of Wako Pure Chemical Industries, Ltd.) (3.8 parts), 40% sodium polyacrylate (product name: ARON P50, product of TOAGOSEI, CO., LTD.) (1.3 parts) and water (49.6 parts) were mixed one another, and the resultant mixture was dispersed with a non-bubbling kneader (product name: NBK-2, product of NISSEI Corporation), to thereby prepare a 65% kaolin dispersion. Subsequently, the thus-prepared 65% kaolin dispersion (7.0 parts), water (5 parts) and 10% Emulgen 109P (product of Kao Corp.) (0.8 parts) were added to a 22.5% aqueous polyester urethane latex dispersion (glass transition temperature: 49° C., minimum film forming temperature: 29° C.; product name: Hydran AP-40F (product of Dainippon Ink and Chemicals, Inc.) (100 parts), followed by sufficiently stirring/mixing. The thus-obtained liquid mixture was maintained at 15° C. to 25° C. to prepare a 24.0% undercoat layer-coating liquid.

<Formation of Undercoat Layer>

The above-prepared undercoat layer-coating liquid was coated on each of both surfaces of woodfree paper having a basis weight of 81.4 g/m$^2$ (product name: Shiraoi, product of Nippon Paper Co.) with a bar coater to a coating amount of 8.0 g/m$^2$, followed by drying at 70° C. for 3 min, to thereby form an undercoat layer. The thickness was found to be 8.1 μm. The thus-formed undercoat layer was subjected to a soft calender treatment as described below.

—Soft Calender Treatment—

The soft calender treatment was carried out with respect to the undercoat layer formed on the woodfree paper with a soft calender having a pair of metal and resin rollers under the following conditions: surface temperature of the metal roller: 50° C. and nip pressure: 50 kg/cm.

<Preparation of Second Layer (Uppercoat)-Coating Liquid>

Kaolin (product name: Kaobrite 90, product of SHIRAISHI CALCIUM KAISHA, LTD.) (100 parts), 0.1N sodium hydroxide (product of Wako Pure Chemical Industries, Ltd.) (3.8 parts), 40% sodium polyacrylate (product name: ARON T-50, product of TOAGOSEI, CO., LTD.) (1.3 parts) and water (49.6 parts) were mixed one another, and the resultant mixture was dispersed with a non-bubbling kneader (product name: NBK-2, product of NISSEI Corporation), to thereby prepare a 65% kaolin dispersion. Subsequently, a 50% latex of styrene-butadiene copolymer with an average particle diameter of 130 nm (product name: Nipol LX407K, product of ZEON CORPORATION) (14 parts), an emulsion of fatty acid calcium (product name: Nopcoat C-104-HS, product of SAN NOPCO LIMITED) (1 part), a 1% carboxymethyl cellulose sodium salt (product name: Serogen EP, product of Dai-ichi Kogyo Seiyaku Co.) (10 parts) and a 10% aqueous emulgen 109P solution (product of Kao Corp.) (0.5 parts) were added to the dispersion, to thereby prepare an overcoat layer-coating liquid having a final solid content of 59%. The thus-prepared overcoat layer-coating liquid was found to have a high-shear viscosity of 50.2 mPa·s to 138.2 mPa·s.

<Formation of Second Layer (Overcoat Layer)>

The above-prepared overcoat layer-coating liquid was coated on each of the undercoat layers formed on the woodfree paper using a high-speed sheet-fed blade coater (PM-9040M, product of SMT Co., Ltd.), followed by drying at 150° C. for 3 sec (air-blasting speed: 20 m/sec), to thereby form an overcoat layer. Note that the coating was performed so that the coating amount by weight was adjusted to 20 g/m$^2$ in a dried state. The thickness was found to be 19.1 μm. The thus-formed overcoat layer was subjected to a soft calender treatment as described below.

—Soft Calender Treatment—

The soft calender treatment was carried out with respect to the overcoat layer formed on the woodfree paper with a soft calender having a pair of metal and resin rollers under the following conditions: surface temperature of the metal roller: 80° C. and nip pressure: 50 kg/cm. Similar to Example 1, "test for Cobb-water absorption degree of woodfree paper with undercoat layer being formed thereon," "water absorption test for woodfree paper with undercoat layer and overcoat layer being formed thereon," "test for bleeding of ink printed," "curling test" and "test for abrasion resistance" were performed. The results are shown in Table 1.

Example 4

The procedure of Example 3 was repeated, except that liquid composition A was changed to liquid composition B having the following components, to thereby perform an image forming method. Similar to Example 1, "test for Cobb-water absorption degree of woodfree paper with undercoat layer being formed thereon," "water absorption test for woodfree paper with undercoat layer and overcoat layer being formed thereon," "test for bleeding of ink printed," "curling test" and "test for abrasion resistance" were performed. The results are shown in Table 1.

—Liquid Composition B—

Glycerin: 7 parts
Diethylene glycol: 5 parts
Olfine E1010 (product of Nissin Chemical Industry Co., Ltd.): 2 parts
Calcium nitrate: 2 parts
Ion-exchange water: 84 parts Example 5

The procedure of Example 3 was repeated, except that liquid composition A was changed to liquid composition C having the following components, to thereby perform an image forming method. Similar to Example 1, "test for Cobb-water absorption degree of woodfree paper with undercoat layer being formed thereon," "water absorption test for woodfree paper with undercoat layer and overcoat layer being formed thereon," "test for bleeding of ink printed," "curling test" and "test for abrasion resistance" were performed. The results are shown in Table 1.

—Liquid Composition C—

Glycerin: 7 parts
Diethylene glycol: 5 parts
Olfine E1010 (product of Nissin Chemical Industry Co., Ltd.): 2 parts
Aluminum nitrate: 5 parts
Ion-exchange water: 81 parts Example 6

The procedure of Example 3 was repeated, except that ink composition A was changed to ink composition B prepared as described below, to thereby perform an image forming method. Similar to Example 1, "test for Cobb-water absorption degree of woodfree paper with undercoat layer being formed thereon," "water absorption test for woodfree paper with undercoat layer and overcoat layer being formed thereon," "test for bleeding of ink printed," "curling test" and "test for abrasion resistance" were performed. The results are shown in Table 1.

—Ink Composition B—

The dispersion CAB-O-JETTM_300 (self-dispersible anionic carbon black) (product of CABOT Co.) (10 parts), an aqueous anionic polymer solution (styrene-acrylic copolymer) (acid value: 200, weight average molecular weight: 10,000, solid content: 10%, a neutralizing agent: potassium hydroxide) (22 parts) and pure water (68 parts) were mixed with one another to prepare a pigment dispersion. The below-listed components were charged into a batch-type vertical sand mill (product of Imex Co., Ltd.) which had been filled with 0.3-mm zirconia beads (140 parts), and the mixture was dispersed for 5 hours under water cooling. The resultant dispersion was centrifuged for removing coarse particles to prepare a 12% by mass pigment dispersion.

After mixing/stirring, the dispersion was filtered through a membrane filter with a pore size of 2 μm to prepare ink composition B.

—Components of Ink Composition B—

The above-prepared pigment dispersion: 30%
Glycerin: 9%
Diethylene glycol: 6%
Olfine E1010 (product of Nissin Chemical Industry Co., Ltd.): 1%
Water: 54%

Example 7

The procedure of Example 3 was repeated, except that liquid composition A was changed to liquid composition D having the following components, to thereby perform an image forming method. Similar to Example 1, "test for Cobb-water absorption degree of woodfree paper with undercoat layer being formed thereon," "water absorption test for woodfree paper with undercoat layer and overcoat layer being formed thereon," "test for bleeding of ink printed," "curling test" and "test for abrasion resistance" were performed. The results are shown in Table 1.

—Liquid Composition D—

Glycerin: 7 parts
Diethylene glycol: 5 parts
Olfine E1010 (product of Nissin Chemical Industry Co., Ltd.): 2 parts
Magnesium nitrate: 15 parts
Ion-exchange water: 71 parts Example 8

The procedure of Example 3 was repeated, except that liquid composition A was changed to liquid composition E having the following components, to thereby perform an image forming method. Similar to Example 1, "test for Cobb-water absorption degree of woodfree paper with undercoat layer being formed thereon," "water absorption test for woodfree paper with undercoat layer and overcoat layer being formed thereon," "test for bleeding of ink printed," "curling test" and "test for abrasion resistance" were performed. The results are shown in Table 1.

—Liquid Composition E—

Glycerin: 7 parts

Diethylene glycol: 5 parts

Olfine E1010 (product of Nissin Chemical Industry Co., Ltd.): 2 parts

Polyguanide: 4 parts

Ion-exchange water: 82 parts

Example 9

The procedure of Example 3 was repeated, except that liquid composition A was changed to liquid composition F having the following components, to thereby perform an image forming method. Similar to Example 1, "test for Cobb-water absorption degree of woodfree paper with undercoat layer being formed thereon," "water absorption test for woodfree paper with undercoat layer and overcoat layer being formed thereon," "test for bleeding of ink printed," "curling test" and "test for abrasion resistance" were performed. The results are shown in Table 1.

—Liquid Composition F—

Glycerin: 7 parts

Diethylene glycol: 5 parts

Olfine E1010 (product of Nissin Chemical Industry Co., Ltd.): 2 parts

Polyguanide: 17 parts

Ion-exchange water: 69 parts

Comparative Example 1

The procedure of Example 1 was repeated, except that the amount of the undercoat layer-coating liquid coated on one surface of woodfree paper was changed from 8.0 g/m$^2$ to 6.0 g/m$^2$, to thereby perform an image forming method. The formed undercoat layer was found to have a thickness of 5.8 μm, and the formed overcoat layer 9.8 μm. Similar to Example 1, "test for Cobb-water absorption degree of woodfree paper with undercoat layer being formed thereon," "water absorption test for woodfree paper with undercoat layer and overcoat layer being formed thereon," "test for bleeding of ink printed," "curling test" and "test for abrasion resistance" were performed. The results are shown in Table 1.

Comparative Example 2

The procedure of Example 1 was repeated, except that a 7.3% undercoat layer-coating liquid was prepared by adding a 4% aqueous solution of 2-ethylenesulfonyl-N-[2-(2-ethylenesulfonyl-acetylamino)-ethyl]-acetamide (12.0 parts), as a hardener solution, to the undercoat layer-coating liquid; that the amount of the undercoat layer-coating liquid coated on one surface of woodfree paper was changed from 8.0 g/m$^2$ to 5.0 g/m$^2$; that, in the overcoat layer-coating liquid, the amount of heavy calcium carbonate (product name: Escaron #2000, product of SANKYO SEIFUN) was changed from 60 parts to 40 parts, the amount of kaolin (product name: Milagros, product of Engelhard (U.S.)) was changed from 20 parts to 40 parts, and the amount of styrene-butadiene copolymer latex (average particle diameter: 95 nm, product name: Smartex PA2323, product of NIPPON A&L) was changed from 11 parts to 15 parts; and that the amount of the overcoat layer-coating liquid coated on one surface of woodfree paper was changed from 11.2 g/m$^2$ to 10.1 g/m$^2$, to thereby perform an image forming method. The formed undercoat layer was found to have a thickness of 4.3 μm, and the formed overcoat layer 11.0 μm. Similar to Example 1, "test for Cobb-water absorption degree of woodfree paper with undercoat layer being formed thereon," "water absorption test for woodfree paper with undercoat layer and overcoat layer being formed thereon," "test for bleeding of ink printed," "curling test" and "test for abrasion resistance" were performed. The results are shown in Table 1.

Comparative Example 3

The procedure of Example 1 was repeated, except that a 7.3% undercoat layer-coating liquid was prepared by adding a 4% aqueous solution of 2-ethylenesulfonyl-N-[2-(2-ethylenesulfonyl-acetylamino)-ethyl]-acetamide (12.0 parts), as a hardener solution, to the undercoat layer-coating liquid; that the amount of the undercoat layer-coating liquid coated on one surface of woodfree paper was changed from 8.0 g/m$^2$ to 5.0 g/m$^2$; that, in the overcoat layer-coating liquid, the amount of heavy calcium carbonate (product name: Escaron #2000, product of SANKYO SEIFUN) was changed from 60 parts to 70 parts, the amount of kaolin (product name: Milagros, product of Engelhard (U.S.)) was changed from 20 parts to 15 parts, the amount of titanium oxide (Typaque R-780, product of ISHIHARA SANGYO KAISHA, LTD.) was changed from 20 parts to 15 parts, and the amount of styrene-butadiene copolymer latex (average particle diameter: 95 nm, product name: Smartex PA2323, product of NIPPON A&L) was changed from 11 parts to 9 parts; and that the amount of the overcoat layer-coating liquid coated on one surface of woodfree paper was changed from 11.2 g/m$^2$ to 10.1 g/m$^2$, to thereby perform an image forming method. The formed undercoat layer was found to have a thickness of 4.6 μm, and the formed overcoat layer 10.6 μm. Similar to Example 1, "test for Cobb-water absorption degree of woodfree paper with undercoat layer being formed thereon," "water absorption test for woodfree paper with undercoat layer and overcoat layer being formed thereon," "test for bleeding of ink printed," "curling test" and "test for abrasion resistance" were performed. The results are shown in Table 1.

Comparative Example 4

The procedure of Example 3 was repeated, except that liquid composition A was changed to liquid composition G having the following components, to thereby perform an image forming method. Similar to Example 1, "test for Cobb-water absorption degree of woodfree paper with undercoat layer being formed thereon," "water absorption test for woodfree paper with undercoat layer and overcoat layer being formed thereon," "test for bleeding of ink printed," "curling test" and "test for abrasion resistance" were performed. The results are shown in Table 1.

—Liquid Composition G—

Glycerin: 7 parts

Diethylene glycol: 5 parts

Olfine E1010 (product of Nissin Chemical Industry Co., Ltd.): 2 parts

Ion-exchange water: 86 parts

TABLE 1

| | Cobb-water absorption degree ($g/m^2$) | | | Bristow method ($mL/m^2$) | | Liquid composition | | Evaluation ranks | | |
|---|---|---|---|---|---|---|---|---|---|---|
| | Water (15 sec) | Water (2 min) | DEG (2 min) | Water | DEG + Water | Polyvalent metal/ cationic polymer | Content (% by mass) | Bleeding | Curling | Abrasion resistance |
| Ex. 1 | 4.8 | 6.8 | 4.7 | 3.1 | 2.0 | Magnesium nitrate | 3 | A | B | B |
| Ex. 2 | 4.5 | 8.1 | 7.1 | 3.2 | 2.0 | Magnesium nitrate | 3 | B | B | B |
| Ex. 3 | 0.1 | 0.9 | 1.4 | 2.8 | 1.8 | Magnesium nitrate | 3 | A | A | A |
| Ex. 4 | 0.1 | 0.9 | 1.4 | 2.8 | 1.8 | Calcium nitrate | 2 | A | A | A |
| Ex. 5 | 0.1 | 0.9 | 1.4 | 2.8 | 1.8 | Aluminum nitrate | 5 | A | A | A |
| Ex. 6 | 0.1 | 0.9 | 1.4 | 2.8 | 1.8 | Magnesium nitrate | 3 | A | A | A |
| Ex. 7 | 0.1 | 0.9 | 1.4 | 2.8 | 1.8 | Magnesium nitrate | 15 | A | A | B |
| Ex. 8 | 0.1 | 0.9 | 1.4 | 2.8 | 1.8 | Polyguanide | 4 | A | A | A |
| Ex. 9 | 0.1 | 0.9 | 1.4 | 2.8 | 1.8 | Polyguanide | 17 | A | A | B |
| Comp. Ex. 1 | 5.2 | 9.2 | 9.9 | 3.0 | 2.2 | Magnesium nitrate | 3 | B | D | B |
| Comp. Ex. 2 | 3.2 | 6.2 | 5.7 | 1.7 | 0.9 | Magnesium nitrate | 3 | B | D | D |
| Comp. Ex. 3 | 3.4 | 5.9 | 5.5 | 8.3 | 7.2 | Magnesium nitrate | 3 | C | D | B |
| Comp. Ex. 4 | 0.1 | 0.9 | 1.4 | 2.8 | 1.8 | Not added | 0 | D | B | C |

What is claimed is:

1. An image forming method comprising:

forming an image using a recording medium, an ink composition and a liquid composition, wherein the recording medium comprises a base paper, a first layer containing a binder, and a second layer containing a white pigment, the first layer and second layer being laid in this order on the base paper, and wherein the base paper on which the first layer has been formed has a Cobb-water absorption degree of 5.0 $g/m^2$ or less as measured according to the water absorption test stipulated in JIS P8140 with water being in contact with the first layer formed on the base paper for 15 sec, the base paper on which the first layer and the second layer have been formed has a water absorption amount of 2 $mL/m^2$ to 8 $mL/m^2$ as measured by the Bristow method with water being in contact with the second layer formed on the first layer and the base paper for 0.5 sec, the ink composition contains a pigment and water, and the liquid composition contains any one of a polyvalent metal salt and a cationic polymer.

2. The image forming method according to claim 1, wherein the polyvalent metal salt content of the liquid composition is 0.01% by mass to 10% by mass.

3. The image forming method according to claim 1, wherein the cationic polymer is selected from poly(vinylpyridine) salts, polyalkylaminoethyl acrylates, polyalkylaminoethyl methacrylates, poly(vinylimidazoles), polyethyleneimines, polybiguanides, polyguanides and combinations thereof.

4. The image forming method according to claim 3, wherein the cationic polymer content of the liquid composition is 0.1% by mass to 15% by mass.

5. The image forming method according to claim 1, wherein the ink composition further contains at least one anionic polymer.

6. The image forming method according to claim 1, wherein the image forming method includes applying the liquid composition onto the recording medium and applying the ink composition onto the resultant recording medium.

7. The image forming method according to claim 1, wherein the ink composition is applied in a single-pass mode.

8. The image forming method according to claim 1, wherein the base paper on which the first layer has been formed has a Cobb-water absorption degree of 2.0 $g/m^2$ or less as measured according to the water absorption test stipulated in JIS P8140 with water being in contact with the first layer formed on the base paper for 2 min.

9. The image forming method according to claim 1, wherein the base paper on which the first layer has been formed has a Cobb value of 5.0 $g/m^2$ or less as measured using diethylene glycol in accordance with the procedure of the water absorption test stipulated in JIS P8140 with the diethylene glycol being in contact with the first layer formed on the base paper for 2 min, and wherein the base paper on which the first layer and the second layer have been formed has an absorption amount of 1 $mL/m^2$ to 6 $mL/m^2$ as measured by the Bristow method using a liquid containing 30% by mass diethylene glycol in pure water with the liquid being in contact with the second layer formed on the first layer and the base paper for 0.9 sec.

10. The image forming method according to claim 1, wherein the second layer has an absorption amount of 1 $mL/m^2$ to 6 $mL/m^2$ as measured by the Bristow method using a liquid containing 30% by mass diethylene glycol in pure water with the liquid being in contact therewith for 0.9 sec.

11. The image forming method according to claim 1, wherein the second layer contains a white pigment in an amount of 10 parts by mass to 60 parts by mass per 100 parts by mass of a thermoplastic resin on a solid basis.

* * * * *